US008854294B2

(12) United States Patent
Sakariya

(10) Patent No.: US 8,854,294 B2
(45) Date of Patent: Oct. 7, 2014

(54) CIRCUITRY FOR INDEPENDENT GAMMA ADJUSTMENT POINTS

(75) Inventor: Kapil V. Sakariya, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 808 days.

(21) Appl. No.: 12/399,526

(22) Filed: Mar. 6, 2009

(65) Prior Publication Data

US 2010/0225571 A1 Sep. 9, 2010

(51) Int. Cl.
*G09G 3/36* (2006.01)
*G09G 3/20* (2006.01)

(52) U.S. Cl.
CPC ..... *G09G 3/2011* (2013.01); *G09G 2330/028* (2013.01); *G09G 2320/0242* (2013.01); *G09G 3/3696* (2013.01); *G09G 2320/0276* (2013.01); *G09G 2310/0235* (2013.01); *G09G 2310/027* (2013.01); *G09G 2320/0666* (2013.01)
USPC ..... 345/102

(58) Field of Classification Search
USPC ..... 345/87
See application file for complete search history.

(56) References Cited

U.S. PATENT DOCUMENTS

| | | | | |
|---|---|---|---|---|
| 6,377,270 | B1 * | 4/2002 | Eitzmann | 345/589 |
| 6,798,368 | B2 | 9/2004 | Jung | |
| 6,801,178 | B2 | 10/2004 | Nitta et al. | |
| 7,136,076 | B2 | 11/2006 | Evanicky et al. | |
| 7,414,600 | B2 | 8/2008 | Nathan et al. | |
| 7,446,747 | B2 | 11/2008 | Youngblood et al. | |
| 7,724,246 | B2 | 5/2010 | Akimoto et al. | |
| 7,760,178 | B2 | 7/2010 | Takada et al. | |
| 7,973,571 | B2 | 7/2011 | Sato et al. | |
| 2002/0000985 | A1 * | 1/2002 | Hashimoto | 345/212 |
| 2002/0011979 | A1 * | 1/2002 | Nitta et al. | 345/89 |
| 2004/0046725 | A1 | 3/2004 | Lee | |
| 2004/0129933 | A1 | 7/2004 | Nathan et al. | |
| 2006/0054893 | A1 | 3/2006 | Nathan et al. | |

(Continued)

FOREIGN PATENT DOCUMENTS

| | | | |
|---|---|---|---|
| CN | 1432987 | A | 7/2003 |
| EP | 1 486 944 | A1 | 12/2004 |

(Continued)

OTHER PUBLICATIONS

Korean Search Report for Korean Application No. 10-2011-7023439 dated Oct. 21, 2011; 10 pgs.

(Continued)

*Primary Examiner* — Quan-Zhen Wang
*Assistant Examiner* — Nelson D Runkle, III
(74) *Attorney, Agent, or Firm* — Fletcher Yoder PC

(57) ABSTRACT

A display architecture providing independent adjustment of gamma with respect to each color channel of a display is provided. In one embodiment, gamma adjustment circuitry may utilize separate resistor strings for each color channel of the display. Gamma adjustment voltage taps for each resistor string may each be coupled to a respective switching logic block that includes a plurality of switches, each of which may be coupled to different respective locations of the resistor string. Based upon a gamma correction profile defining optimal gamma adjustment points for a particular color channel based at least partially upon its transmittance sensitivity characteristics, appropriate control signals may be provided to each of the switching logic blocks to facilitate the connection of the gamma adjustment voltage taps to desired adjustment points on a respective resistor string in order to optimize gamma correction and provide for increased accuracy in color output.

25 Claims, 14 Drawing Sheets

(56) References Cited

U.S. PATENT DOCUMENTS

| | | | | |
|---|---|---|---|---|
| 2006/0145980 | A1* | 7/2006 | Koma | 345/88 |
| 2006/0214895 | A1 | 9/2006 | Shih | |
| 2006/0244692 | A1 | 11/2006 | Yoo et al. | |
| 2006/0256065 | A1 | 11/2006 | Jung | |
| 2006/0279498 | A1* | 12/2006 | Kaneda et al. | 345/89 |
| 2007/0030234 | A1 | 2/2007 | Akimoto et al. | |
| 2007/0063945 | A1* | 3/2007 | Hung et al. | 345/88 |
| 2007/0182671 | A1 | 8/2007 | Nathan et al. | |
| 2008/0030444 | A1* | 2/2008 | Hsueh | 345/87 |
| 2008/0048951 | A1 | 2/2008 | Naugler, Jr. | |
| 2008/0158167 | A1 | 7/2008 | Hotelling | |
| 2008/0291190 | A1 | 11/2008 | Kim et al. | |

FOREIGN PATENT DOCUMENTS

| | | | |
|---|---|---|---|
| EP | 1486944 | A1 | 12/2004 |
| JP | 2006-146134 | A | 6/2006 |
| KR | 10-2004-0023241 | A | 3/2004 |
| KR | 10-2006-0117026 | A | 11/2006 |

OTHER PUBLICATIONS

C. Zajac, S. Poniatowski; P-35: System Design Considerations for TFT-LCD Panels Using Sample and Hold Based Column Drivers; 2003 SID.

U.S. Appl. No. 12/399,497, filed Mar. 6, 2009, Kapil V. Sakariya.

Korean Preliminary Rejection for Korean Application No. 10-2011-7023439 dated Dec. 9, 2011; 8 pgs.

Chinese Office Action for CN Application No. 201080014330.6 dated May 31, 2013, 8 pgs.

* cited by examiner

CIRCUITRY FOR INDEPENDENT GAMMA ADJUSTMENT POINTS

BACKGROUND

The present disclosure relates generally to electronic displays and, more particularly, to gamma adjustment techniques for such displays. This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Liquid crystal displays (LCDs) are commonly used as screens or displays for a wide variety of electronic devices, including such consumer electronics as televisions, computers, and handheld devices (e.g., cellular telephones, audio and video players, gaming systems, and so forth). Such LCD devices typically provide a flat display in a relatively thin and low weight package that is suitable for use in a variety of electronic goods. In addition, such LCD devices typically use less power than comparable display technologies, making them suitable for use in battery powered devices or in other contexts where it is desirable to minimize power usage.

LCD devices typically include thousands (or millions) of picture elements, i.e., pixels, arranged in rows and columns. For any given pixel of an LCD device, the amount of light that viewable on the LCD depends on the voltage applied to the pixel. Typically, LCDs include driving circuitry for converting digital image data into analog voltage values which may be supplied to pixels within a display panel of the LCD. However, due at least partially to the digital-to-analog conversion process and the generally non-linear response of the human eye with regard to digital levels of luminance, the encoded luminance characteristics and color output or digital images displayed on an LCD, commonly referred to as "gamma," may not always be accurate when perceived by a user viewing the display.

To at least partially compensate for such inaccuracies, some conventional display devices utilize driving circuitry that includes gamma adjustment circuitry providing for a limited degree of gamma correction. For instance, conventional digital-to-analog conversion gamma architectures typically rely on a string of resistors for producing all possible output voltages levels that may be output to a display device. To provide for gamma correction, one or more gamma adjustment points may be located along the resistor string. These adjustment points may be used to pin voltages at certain locations along the resistor string in order to modify the voltage division ratios, thereby modifying the voltage output levels from the resistor string.

Generally, however, once such gamma points are selected, they are fixed at certain locations along the resistor string. Further, in displays utilizing multiple color channels in which separate resistor strings are employed for each color channel, the gamma adjustment points are located that the same relative locations along each resistors string. Thus, such an arrangement may not always provide for accurate gamma correction because the gamma adjustment points may not be concentrated among the maximum transmittance sensitivity areas for each color channel.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to a gamma architecture that provides for the selection of gamma adjustment voltage points in a manner that is independent with respect to each color channel in a display device. In one embodiment, gamma adjustment circuitry may utilize separate resistor strings for each color channel of the display. Gamma adjustment voltage taps for each resistor string may each be coupled to a respective switching logic block that includes a plurality of switches, each of which may be coupled to different respective locations of the resistor string. Based upon a gamma correction profile defining gamma adjustment points for a particular color channel based at least partially upon its transmittance sensitivity characteristics, appropriate control signals may be provided to each of the switching logic blocks to facilitate the connection of the gamma adjustment voltage taps to desired adjustment points on a respective resistor string in order to substantially optimize gamma correction and provide for increased accuracy in color output. In another embodiment, the independent gamma adjustment architecture may utilize the same resistor string for outputting voltages for each color channel. In such an embodiment, a time division multiplexing scheme may be employed such that data corresponding to each color channel is transmitted at discrete timeslots.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
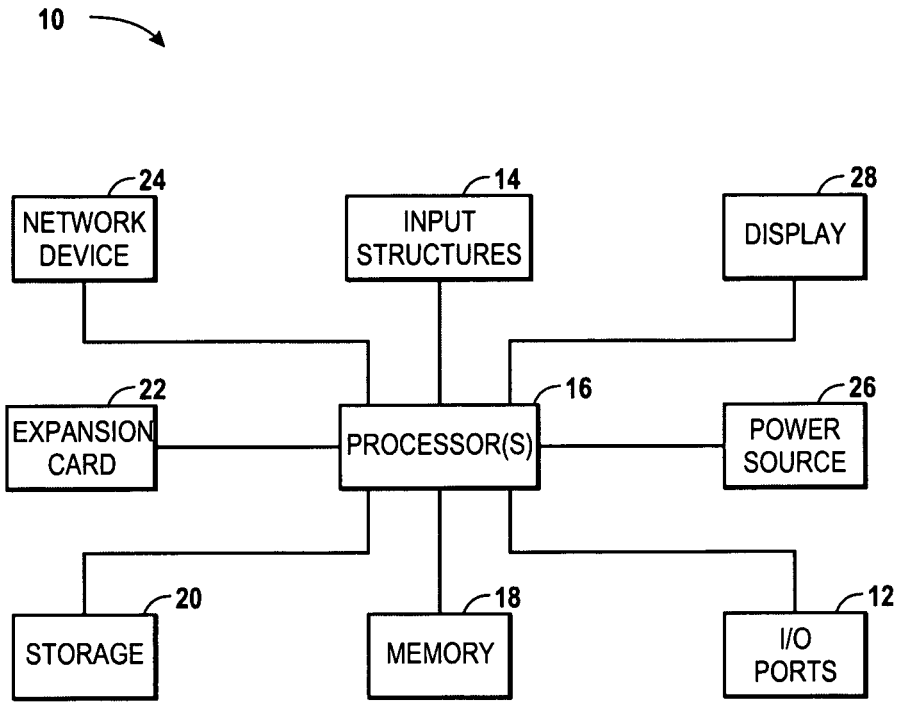
FIG. 1 is a block diagram depicting components of an example of an electronic device that includes a display device, in accordance with aspects of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure generally provides for the independent adjustment of gamma for each of a plurality of color channels utilized by a display device. The gamma adjustment circuitry, in one embodiment, includes multiple resistor strings, one for each color channel of the display. Each resistor string may receive a plurality of gamma adjustment voltage taps. The locations of gamma adjustment voltages may be determined based upon respective gamma correction profiles associated with each color channel. In accordance with one aspect of the presently disclosed techniques, each resistor string may include a plurality of switching logic blocks, each including a plurality of switches coupled to respective locations along the resistor string. Based upon a respective gamma correction profile corresponding to the color channel with which a particular resistor string is associated, an appropriate switch may be selected within each switching logic block, thereby coupling the gamma adjustment voltage tap to a particular location along the resistor string corresponding to the selected switch. Such gamma correction profiles may be determined based upon a transmittance sensitivity curve for each color channel. As will be discussed in further detail below, such an embodiment advantageously provides for the selection of adjustment points at which gamma adjustment voltages are applied to a resistor string that is independent with respect to each color channel of the display device.

In a further embodiment, the gamma adjustment circuitry may include a single resistor string that outputs voltages for each of a plurality of color channels utilized in a display device during different timeslots via a time division multiplexing scheme, for example. The gamma adjustment circuitry may include a switching matrix providing a one-to-one mapping in certain embodiments such that each provided gamma adjustment voltage may be coupled to any output voltage level along the resistor string. During each timeslot, a corresponding gamma correction profile may be utilized depending on the color being processed to determine the locations within the switching matrix at which switches are selected. In operation, each color channel may be processed in sequential timeslots defined by the time division multiplexing scheme as image data is processed and displayed on the display device. For example, where a display device utilizes red, green, and blue color channels, respective sets of gamma adjustment points may be applied in a repeating alternating manner. For instance, a red gamma correction profile defining a first set of gamma adjustment points on the resistor string may be applied to the switching matrix during a first timeslot. Green and blue correction profiles defining respective second and third sets of gamma adjustment points on the resistor string may be applied to the switching matrix during respective second and third timeslots. Thereafter, the process repeats in which the red, green, and blue correction profiles are repeatedly applied at fourth, fifth, and sixth timeslots, respectively, and so forth.

Keeping the above points in mind, FIG. 1 is a block diagram illustrating an example of an electronic device 10 that may utilize the independent gamma adjustment techniques disclosed herein, in accordance with one embodiment of the present disclosure. Electronic device 10 may be any suitable device that includes a display, such as a personal computer, a laptop, a portable media player, a television, mobile phone, a personal data organizer, or the like. Electronic device 10 may include various internal and/or external components which contribute to the function of the device 10. Those of ordinary skill in the art will appreciate that the various functional blocks shown in FIG. 1 may comprise hardware elements (including circuitry), software elements (including computer code stored on a computer-readable medium) or a combination of both hardware and software elements.

It should further be noted that FIG. 1 is merely one example of a particular implementation and is intended to illustrate the types of components that may be present in electronic device 10. For example, in the presently illustrated embodiment, these components may include input/output (I/O) ports 12, input structures 14, one or more processors 16, memory device 18, non-volatile storage 20, expansion card(s) 22, networking device 24, power source 26, and display 28. By way of example, electronic device 10 may be a portable electronic device, such as a model of an iPod® or iPhone® available from Apple Inc. of Cupertino, Calif. In another embodiment, electronic device 10 may be a desktop or laptop computer, including a MacBook®, MacBook® Pro, MacBook Air®, iMac®, Mac® Mini, or Mac Pro® available from Apple Inc. In further embodiments, electronic device 10 may be a model of an electronic device from a variety of other manufacturers.

Display 28 may be used to display various images generated by the device 10. The display may be any suitable display such as a liquid crystal display (LCD), plasma display, or an organic light emitting diode (OLED) display, for example. In one embodiment, the display 28 may be an LCD employing fringe field switching (FFS), in-plane switching (IPS), or other techniques useful in operating such LCD devices. Such LCD's may include transmissive, reflective, or emissive display panels. Additionally, in certain embodiments, display 28 may be provided in conjunction with a touchscreen, which may serve a component of input structures 14 and function as part of the control interface for device 10. Typically, display 28 may be a color display utilizing a plurality of color channels for generating color images. By way of example, display 28 may utilize a red, green, and blue color channel. As will be described in further detail below, display 28 may include circuitry or suitably configured logic to provide for the independent adjustment of gamma characteristics for each color channel.

Figure 2:
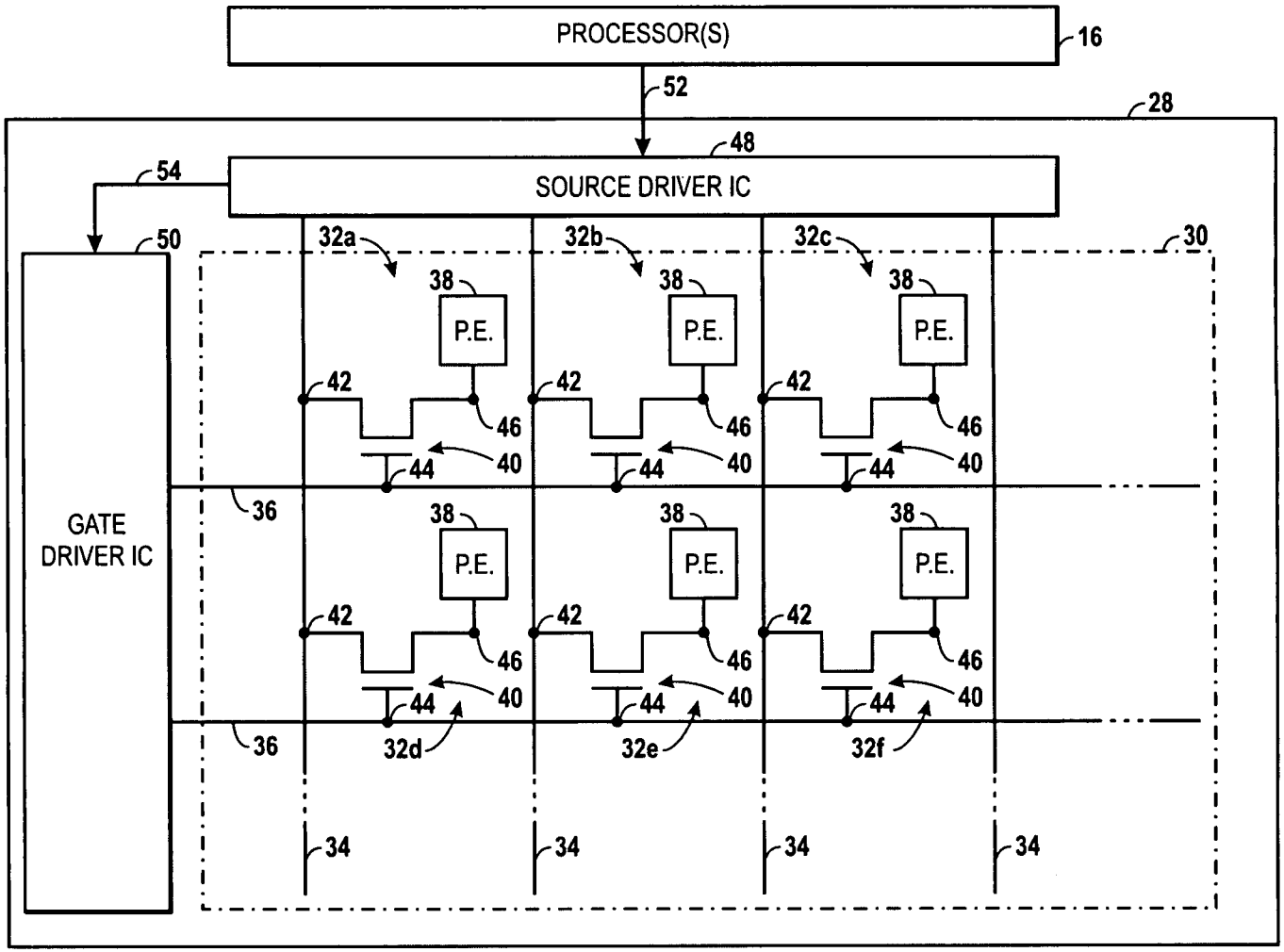
FIG. 2 is a circuit diagram illustrating an example of switching and display circuitry that may be included in the display device of FIG. 1, in accordance with aspects of the present disclosure.

Referring now to FIG. 2, a circuit diagram of display 28 is illustrated, in accordance with an embodiment. As shown, display 28 may include display panel 30. Display panel 30 may include a plurality of unit pixels 32 disposed in a pixel array or matrix defining a plurality of rows and columns of unit pixels that collectively form an image viewable region of display 28. In such an array, each unit pixel 32 may be defined by the intersection of rows and columns, represented here by the illustrated gate lines 36 (also referred to as "scanning lines") and source lines 34 (also referred to as "data lines"), respectively.

Although only six unit pixels, referred to individually by the reference numbers 32*a*-32*f*, respectively, are shown in the present example for purposes of simplicity, it should be understood that in an actual implementation, each source line 34 and gate line 36 may include hundreds or even thousands of unit pixels. By way of example, in a color display panel 30 having a display resolution of 1024×768, each source line 34, which may define a column of the pixel array, may include 768 unit pixels, while each gate line 36, which may define a row of the pixel array, may include 1024 groups of unit pixels, wherein each group includes a red, blue, and green pixel, thus totaling 3072 unit pixels per gate line 36. As will be appreciated, in the context of LCDs, the color of a particular unit pixel generally depends on a particular color filter that is disposed over a liquid crystal layer of the unit pixel. In the presently illustrated example, the group of unit pixels 32*a*-32*c* may represent a group of pixels having a red pixel (32*a*), a blue pixel (32*b*), and a green pixel (32*c*). The group of unit pixels 32*d*-32*f* may be arranged in a similar manner.

As shown in the present figure, each unit pixel 32*a*-32*f* includes a thin film transistor (TFT) 40 for switching a respective pixel electrode 38. In the depicted embodiment, the source 42 of each TFT 40 may be electrically connected to a source line 34. Similarly, the gate 44 of each TFT 40 may be electrically connected to a gate line 36. Furthermore, the drain 46 of each TFT 40 may be electrically connected to a respective pixel electrode 38. Each TFT 40 serves as a switching element which may be activated and deactivated (e.g., turned on and off) for a predetermined period based upon the respective presence or absence of a scanning signal at gate 44 of TFT 40. For instance, when activated, TFT 40 may store the image signals received via a respective source line 34 as a charge in pixel electrode 38. The image signals stored by pixel electrode 38 may be used to generate an electrical field that energizes the respective pixel electrode 38 and causes the pixel 32 to emit light at an intensity corresponding to the applied voltage. For instance, in an LCD panel, such an electrical field may align liquid crystals molecules within a liquid crystal layer 72 (not shown) to modulate light transmission through the liquid crystal layer.

Display 28 may further include source driver integrated circuit (source driver IC) 48, which may include a chip, such as a processor or ASIC, that is configured to control various aspects of display 28 and panel 30. For example, source driver IC 48 may receive image data 52 from processor(s) 16 and send corresponding image signals to unit pixels 32*a*-32*f* of panel 30. Source driver IC 48 may also be coupled to gate driver IC 50, which may be configured to activate or deactivate pixels 32 via gate lines 36. As such, source driver IC 48 may send timing information, shown here by reference number 54, to gate driver IC 50 to facilitate activation/deactivation of individual rows of pixels 32. While the illustrated embodiment shows a single source driver IC 48 coupled to panel 30 for purposes of simplicity, it should be appreciated that additional embodiments may utilize a plurality of source driver ICs 48. For example, additional embodiments may include a plurality of source driver ICs 48 disposed along one or more edges of panel 30, wherein each source driver IC 48 is configured to control a subset of source lines 34 and/or gate line 36.

In operation, source driver IC 48 receives image data 52 from processor 16 and, based on the received data, outputs signals to control pixels 32. To display image data 52, source driver IC 48 may adjust the voltage of pixel electrodes 38 (abbreviated in FIG. 2 as P.E.) one row at a time. To access an individual row of pixels 32, gate driver IC 50 may send an activation signal to TFTs 40 associated with the particular row of pixels 32 being addressed. This activation signal may render the TFTs 40 on the addressed row conductive. Accordingly, image data 52 corresponding to the addressed row may be transmitted from source driver IC 48 to each of the unit pixels 32 within the addressed row via respective data lines 34. Thereafter, gate driver IC 50 may deactivate TFTs 40 in the addressed row, thereby impeding the pixels 32 within that row from changing state until the next time they are addressed. The above-described process may be repeated for each row of pixels 32 in panel 30 to reproduce image data 52 as a viewable image on display 28.

In sending image data to each of the pixels 32, a digital image is typically converted into numerical data so that it can be interpreted by a display device. For instance, the image 52 may itself be divided into small "pixel" portions, each of which may correspond to a respective pixel 32 of panel 30. In order to avoid confusion with the physical unit pixels 32 of the panel 30, the pixel portions of the image 52 shall be referred to herein as "image pixels." Each "image pixel" of image 52 may be associated with a numerical value, which may be referred to as a "data number" or a "digital level," that quantifies the luminance intensity (e.g., brightness or darkness) of the image 52 at a particular spot. The digital level value of each image pixel typically represents a shade of darkness or brightness between black and white, commonly referred to as gray levels. As will be appreciated, the number of gray levels in an image usually depends on the number of bits used to represent pixel intensity levels in a display device, which may be expressed as $2^N$ gray levels, where N is the number of bits used to express a digital level value. By way of example, in an embodiment where display 28 is a "normally black" display using 8 bits to represent a digital level, display 28 may be capable of providing 256 gray levels (e.g., $2^8$) to display an image, wherein a digital level of 0 corresponds to full black (e.g., no transmittance), and a digital level of 255 correspond to full white (e.g., full transmittance). In another embodiment, if 6 bits are used to represent a digital level, then 64 gray levels (e.g., $2^6$) may be available for displaying an image.

To provide some examples, in one embodiment, source driver IC 48 may receive an image data stream equivalent to 24 bits of data, with 8-bits of the image data stream corresponding to a digital level for each of the red, green, and blue color channels corresponding to a pixel group including red, green, and blue unit pixel (e.g., 32*a*-32*c* or 32*d*-32*f*). In another embodiment, source driver IC 48 may receive 18-bits of data in an image data stream, with 6-bits of the image data corresponding to each of the red, green, and blue color channels, for example. Further, although digital levels corresponding to luminance are generally expressed in terms of gray levels, where a display utilizes multiple color channels (e.g., red, green, blue), the portion of the image corresponding to each color channel may be individually expressed as in terms of such gray levels. Accordingly, while the digital level data for each color channel may be interpreted as a grayscale image, when processed and displayed using unit pixels 32 of panel 30, color filters (e.g., red, blue, and green) associated with each unit pixel 32 allows the image to be perceived as a color image.

As will be appreciated, the luminance characteristics of viewable representations of digital image data displayed by a display device, such as display 28, may not always be reproduced accurately (e.g., relative to "raw" image data 52) when perceived by a user viewing display 28. Generally, such inaccuracies may be attributed at least partially to the digital-to-analog conversion of digital levels within source driver IC 48 and/or the non-linear response of the human eye and may result in the inaccurate portrayal of colors on display 28 from the viewpoint of a user. As will be explained further below, to compensate for such inaccuracies, source driver IC 48 may provide for independent gamma correction or adjustment of each color channel of display 28, in accordance with aspects of the present disclosure.

Figure 3:
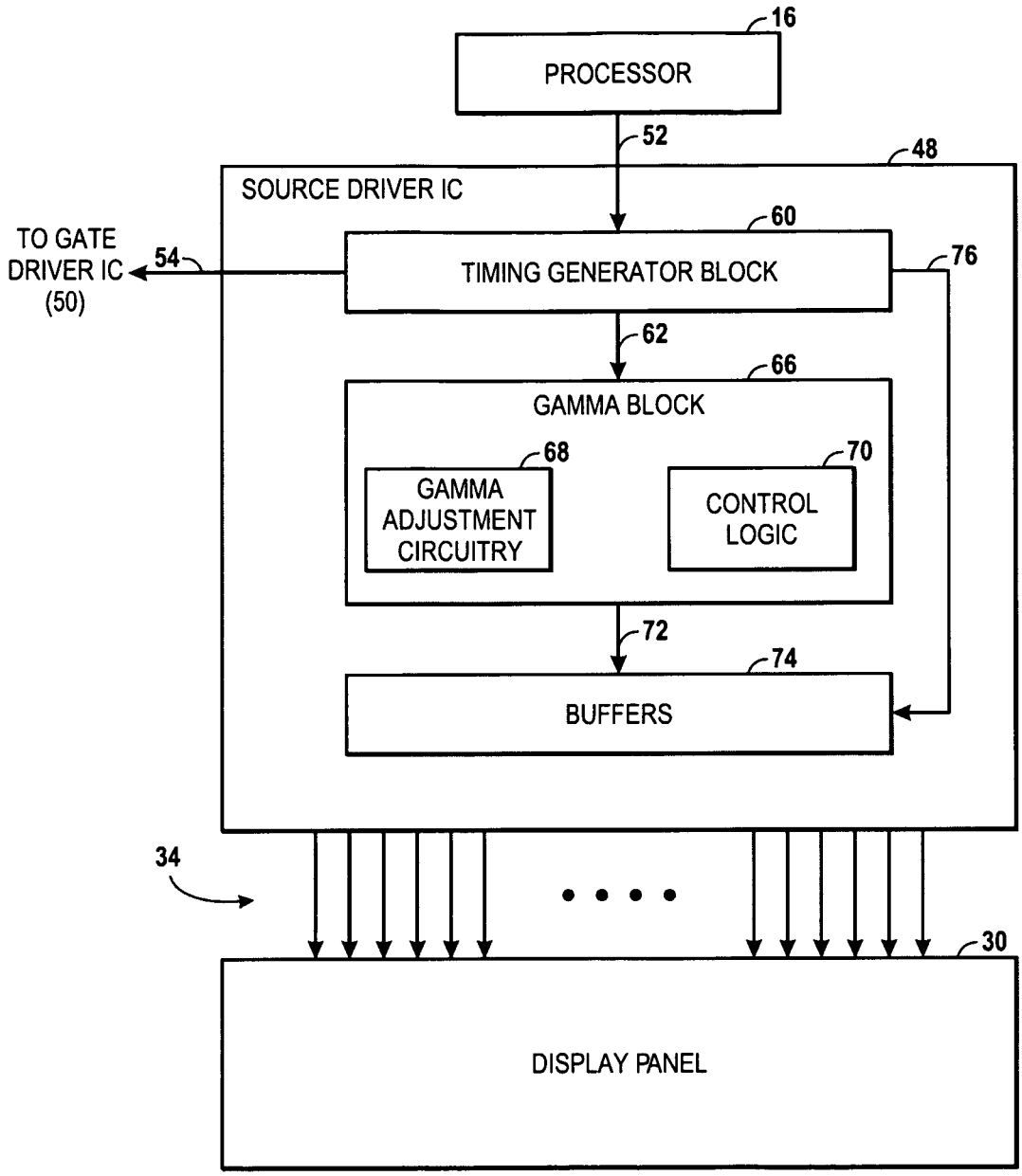
FIG. 3 is a block diagram showing a processor and an example of a source driver integrated circuit (IC) of FIG. 2, in accordance with aspects of the present disclosure.

Continuing now to FIG. 3, a more detailed block diagram of source driver IC 48 is illustrated. As shown, source driver IC 48 may include various logic blocks for processing image data 52 received from processor 16, including timing generator block 60, gamma block 66, and frame buffer 74. Timing generator block 60 may generate appropriate timing signals for controlling source driver IC 48 and gate driver IC 50. For instance, timing generator block 60 may control the transmission of image data 52 to gamma block 66, frame buffers 74, and source lines 34. By way of example, timing generator block 60 may provide a portion 62 of image data 52 to gamma block 62 in a timed manner. For instance, portion 62 of image data 52 may represent image signals transmitted in line-sequence via a predetermined timing. Timing generator block 60 may additionally provide appropriate timing signals 54 to gate driver IC 50, such that scanning signals along gate lines 36 (FIG. 2) may be applied by line sequence with a predetermined timing and/or in a pulsed manner to appropriate rows of unit pixels 32.

Gamma block 66 includes gamma adjustment circuitry 68 and control logic 70. As briefly mentioned above, gamma correction or adjustment may be utilized to compensate for inaccuracies that occur in reproducing viewable representations of digital image data, such as those resulting from the non-linear human eye response and/or the digital-to-analog conversion of digital levels. In accordance with aspects of the present disclosure that will be described in further detail below, gamma adjustment circuitry 68 may provide for the independent gamma adjustment of a plurality of color channels, such as a red, green, and blue channel. Further, while various embodiments disclosed herein pertain to displays having red, green, and blue channels (RGB), it should be appreciated that displays additional embodiments may utilize other suitable color configurations, such as a four-channel red, green, blue, and white (RGBW) display, or a cyan, magenta, yellow, and black (CMYB) display.

To provide for independent gamma adjustment "tap" points for each color channel, gamma adjustment circuitry 68 may be controlled by gamma control logic 70. Gamma control logic 70 may include a processor, as well as a memory for storing one or more gamma correction "profiles" (e.g., one profile for each color channel). As will be discussed further below, each profile may be determined based upon the transmittance sensitivities of each color channel over a range of applied voltages. Thus, in a display having a red, green, and blue color configuration, each color channel may be independently adjusted by gamma control logic 70 applying respective red, green, and blue gamma correction profiles to gamma adjustment circuitry 68. Accordingly, frame buffer 74 may receive from gamma block 66 a "gamma-corrected" voltage 72. Frame buffer 74, which may also receive timing signals 76 from timing generator block 60, may output the gamma-corrected voltage data 72 to display panel 30 by way of source lines 34.

Figure 4:
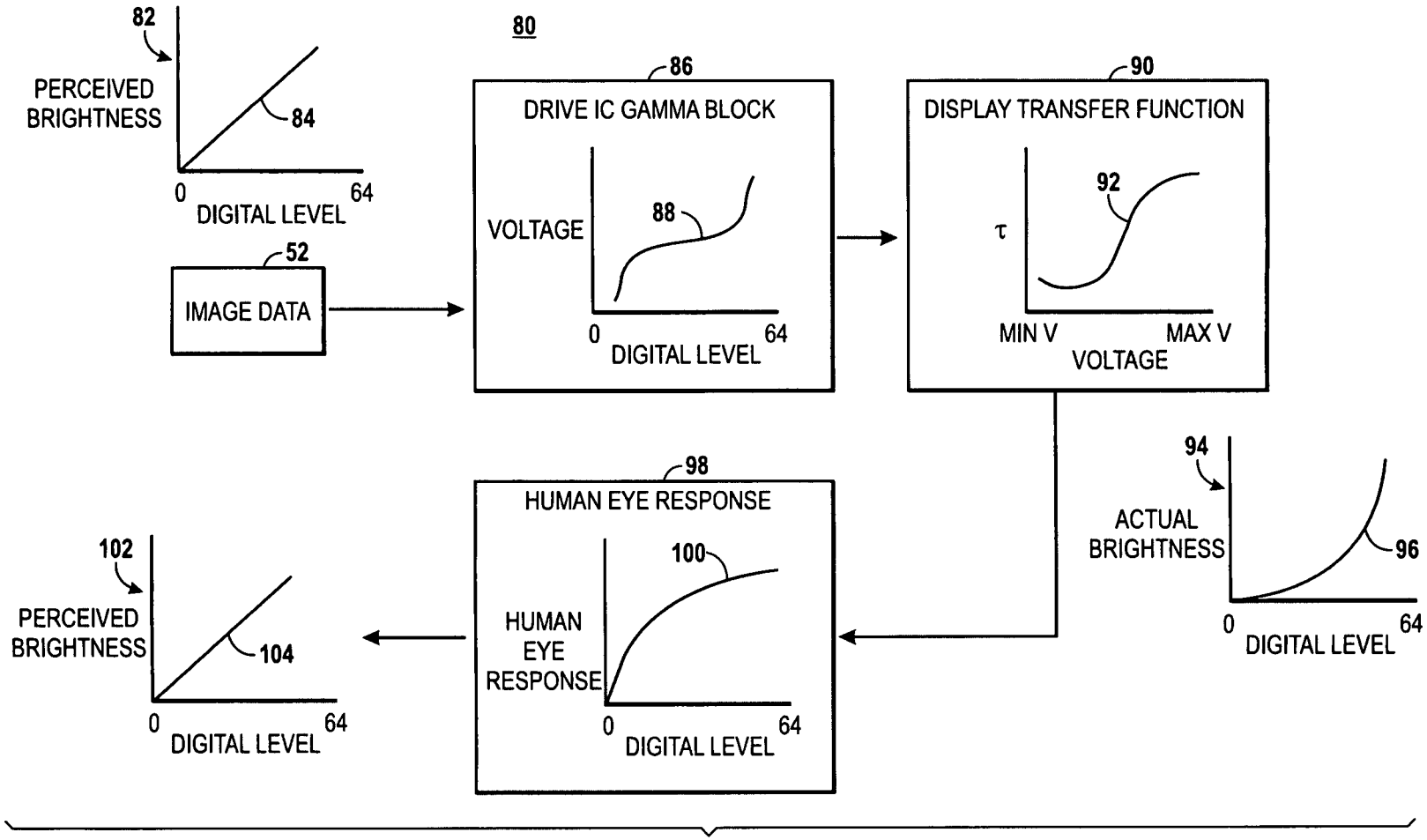
FIG. 4 is a flowchart generally depicting how digital image data may be processed by a display device and perceived by a user viewing the display device.

Before discussing specific embodiments that provide for independent gamma adjustment of each color channel of display 28, as briefly mentioned above, it is believed that a short discussion with regard to conventional gamma adjustment techniques will serve to facilitate a better understanding of the benefits provided by the independent gamma adjustment techniques disclosed herein. Referring now to FIG. 4, a process flow diagram 80 depicting how image data 52 may be processed by gamma block 60, displayed by panel 30 and perceived by user is illustrated. Graph 82 depicts the relationship between how digital levels of image data 52 correspond to a perceived brightness. In the presently illustrated example, 6 bits may be used to represent pixel intensity levels, thus providing for 64 digital levels. As can be seen, the relationship between digital levels and perceived brightness of image data 52 is generally linear, as depicted by curve 84.

As image data 52 is received by gamma block 66, the digital levels may be converted into an analog voltage. For example, referring to graph 86, digital levels are converted into analog voltage data in accordance with curve 88, in which higher digital levels are generally assigned higher voltage values. By way of example, such conversion may be facilitated using a digital-to-analog converter, such as a resistor-string-based architecture. Next, the voltage levels determined by gamma block 66 may be provided to panel 30, such as by way of source lines 34, as discussed above. Graph 90, depicts a transfer function that may be characteristic of display panel 30. As illustrated, a higher voltage applied to unit pixels within the panel results in generally higher transmittance, as indicated by curve 92. As will be appreciated, the functions represented by curves 88 and 92 may be characteristic of a "normally-black" liquid crystal display, in which unit pixels 32 of the display block light in an unactivated state. That is, unit pixels 32 become increasingly transmissive when a voltage is applied to their corresponding pixel electrodes (e.g., 38). In other embodiments, a "normally-white" liquid crystal display, which has a manner of operation that is generally opposite of a "normally-black" display may also be utilized. In such an embodiment, unit pixels (e.g., 32) may transmit light in an unactivated state. That is, unit pixels 32 may become less transmissive when a voltage is applied to their corresponding pixel electrodes.

As shown, graph 90 depicts the relationship between the voltage received from gamma block 66 and a corresponding transmittance characteristic, as shown by the curve 92. Referring now to the graph 94, the displayed image (e.g., output of display panel 30) may exhibit brightness characteristics represented by the curve 96. As shown, the relationship between digital level and actual brightness of a viewable image displayed on panel 30 is not linear. This is due largely to the response of the human eye which, as discussed above, perceives digital levels in a generally non-linear manner with respect to brightness, as shown by curve 100 in graph 98. Thus, while the displayed image on panel 30 may exhibit a non-linear brightness to digital level relationship, as shown by graph 94, when viewed by a user, the response of the human eye may cause the user to perceive the displayed image as having a generally linear relationship between brightness and digital levels, as shown by curve 104 of graph 102.

Thus, as illustrated by process flow 80, one goal of a display device is to produce a viewable representation of image data 52 that may be perceived by a user as having a generally linear relationship with regard to digital levels and perceived brightness (e.g., graph 102). However, as discussed above, luminance characteristics of viewable images displayed on a display device may not always be reproduced accurately. For instance, such inaccuracies may be attributed to characteristics of digital-to-analog conversion circuitry, such as selected resistor values in a resistor string, among other factors. For instance, as will be appreciated, the various components making up display panel 28, such as source driver IC 48 and panel 30, may often be manufactured by different vendors. Thus, where source driver IC 48 includes digital-to-analog conversion circuitry in the form of a resistor string, the resistor values selected by one vendor may not always match the requirements of a panel 30 produced by a different vendor, thus resulting in gamma inaccuracies. In such instances, gamma adjustment or correction techniques may be utilized to compensate for such inaccuracies in order to provide a more accurate color output.

Figure 5:
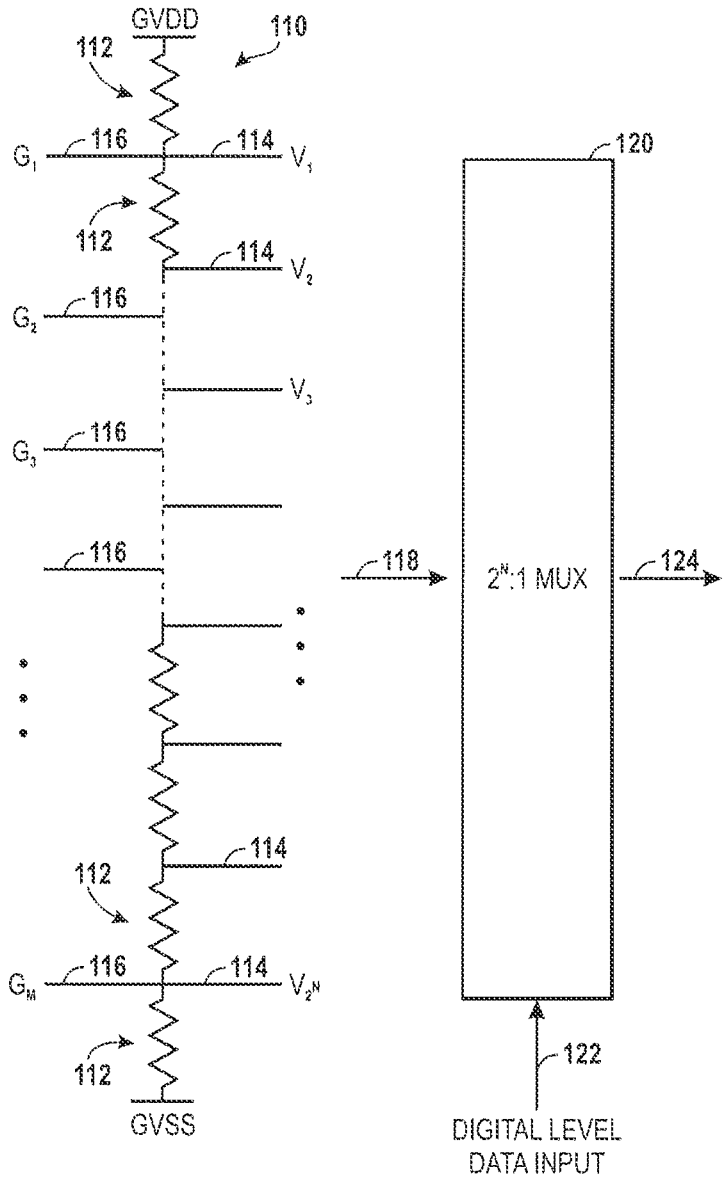
FIG. 5 (PRIOR ART)
FIG. 5 is a circuit diagram illustrating a conventional gamma adjustment circuit having fixed gamma tap points.

For example, turning now to FIG. 5, a circuit diagram depicting a conventional digital-to-analog converter circuit that provides a limited degree of gamma adjustment is illustrated. As shown, the conventional digital-to-analog converter may include a resistor string 110 that includes a plurality of resistors 112. Resistor string 110 may be used to produce all possible all output voltage levels $V_1$-$V_2^N$, collectively depicted here by reference number 114. The number of voltage levels that may be provided by resistor string 110 may depend on the number of bits used to represent pixel intensity levels. For example, if 6 bits are used to represent each pixel, then 64 total voltage levels ($V_1$-$V_{64}$) may be available. The illustrated circuit includes multiplexer 120, which may receive the output from resistor string 110. While multiplexer 120 is illustrated a single logic block for purposes of simplicity, it should be understood that multiplexer 120 may include a plurality of selection circuits, each receiving the voltage outputs $V_1$-$V_2^N$ from resistor string 110 and a respective digital level signal (e.g., from input 122). The output 124 of multiplexer may collectively represent the respective outputs of each selection circuit within multiplexer 120. For instance, multiplexer 120 may provide a respectively selected output to each source line 34 of display panel 28. Thus, in the present example, where 64 voltage levels are output by resistor string 110, multiplexer 120 may receive 64 total inputs, corresponding to a respective output voltage level of resistor string 110, as represented by input signal 118. Based upon a digital level data input 122, which functions as a selection signal, multiplexer 120 selects the appropriate voltage from input signal 118 and outputs appropriate selected voltages 124 to a viewing panel (e.g., to each source line 34), such as an LCD panel. As will be understood, the values selected for each of resistors 112 in resistor string 110 may determine each of the output voltage levels $V_1$-$V_2^N$. Thus, although each of resistors 112 is referred to by a common reference number in the present figure, it should be understood that each of resistors 112 may not necessarily have the same resistance value.

As shown, a plurality of gamma adjustment points may be located along resistor string 110. These adjustment or "tap" points, referred to collectively by reference number 116, may provide gamma adjustment voltages $G_1$-$G_M$ at certain locations along resistor string 110 to modify the voltage division ratios, thereby modifying one or more of the output voltage levels 114. As will be appreciated by those skilled in the art, the gamma adjustment voltages applied to each of gamma tap points $G_1$-$G_M$ may be appropriately selected based upon transmittance sensitivities of a particular color channel to applied voltage levels, as will be discussed further below. Generally, a maximum number of gamma tap points M may be provided when a respective gamma tap is coupled to each output voltage level. That is, the maximum number of gamma tap points M in the depicted embodiment may be equal to $2^N$, wherein one gamma tap point is provided to each output voltage level $V_1$-$V_2^N$ from the resistor string 110. In some embodiments, taps may also be applied to one or both of the supply voltage GVDD and GVSS coupled to the resistor string 110. In practice, however, the number of gamma tap points is ideally selected such that M is less than $2^N$ in order to minimize the complexity of the gamma adjustment circuitry. By way of example only, in one embodiment of a 6-bit display architecture, M may be selected as being between 5 to 13 gamma taps. In another embodiments, M may be selected as 64 (e.g., $2_6$), to provide a respective tap for each voltage level $V_1$ to $V_{64}$. Thus, as will be understood, a greater number of gamma tap points (M) provides for greater gamma adjustment control, but also adds to the complexity of the gamma adjustment circuitry.

Figure 7:
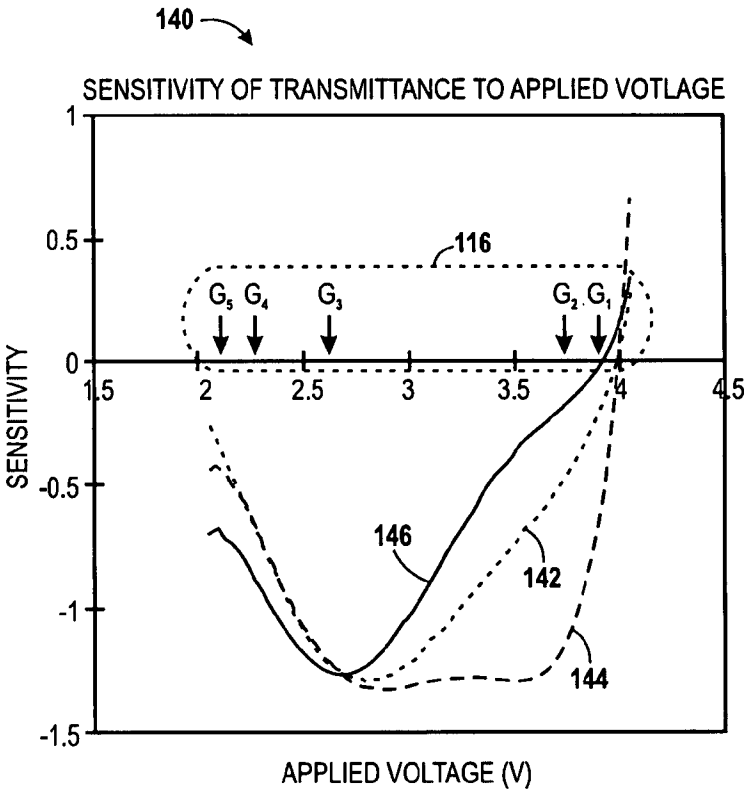
FIG. 7 is a graph depicting a relationship between applied voltages and transmittance sensitivity characteristics for a plurality of color channels, in accordance with aspects of the present disclosure.
Figure 6:
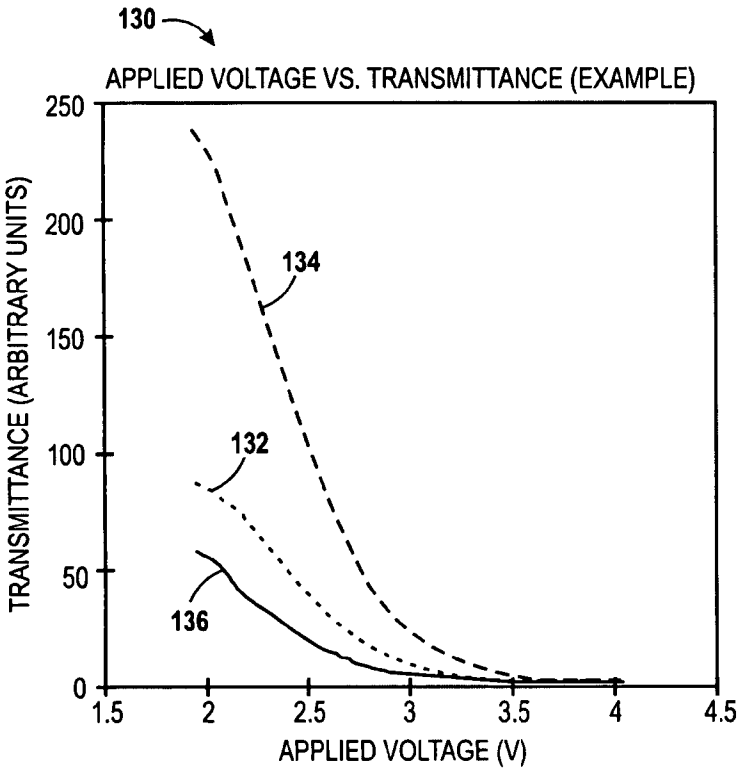
FIG. 6 is graph depicting relationships between applied voltages and transmittance characteristics for a plurality of color channels, in accordance with aspects of the present disclosure.

The concepts regarding gamma tap points and transmittance sensitivity discussed above may be better understood with reference to FIGS. 6 and 7. Turning now to FIG. 6, a graph 130 depicting an example of the relationship between voltages applied to a display panel and corresponding transmittance characteristics is illustrated for each of a plurality of color channels, such as a red channel, a green channel, and a blue channel. In graph 130, the relationship between applied voltage and a corresponding transmittance for each of the red, green, and blue channels are represented by curves 132, 134, and 136, respectively. As will be appreciated, the illustrated transmittance for each of curves 132, 134, and 136 may be characteristic of a "normally-white" LCD panel, as discussed above. That is, transmittance decreases as an applied voltage is increased.

Based on curves 132, 134, and 136 shown in graph 130 of FIG. 6, respective sensitivity curves 142, 144, and 146 for each of the red, green, and blue color channels may be derived, as shown by graph 140 of FIG. 7. Sensitivity curves 142, 144, and 146 generally depict the sensitivity of transmittance with respect to a range of voltages applied to a display panel. As used herein, where the descriptive terms "greatest," "most," "highest," or the like are applied to the discussion of transmittance sensitivities, these terms shall be understood to refer to the magnitude or absolute value of such transmittance sensitivities. For example, referring to curve 142, the red color channel exhibits greatest transmittance sensitivity at applied voltages of approximately 2.6 to 2.8 volts. In the illustrated example, curve 146 corresponding to the blue color channel exhibits a generally similar characteristic to the red color channel (curve 142) and exhibits greatest transmittance sensitivity at approximately 2.5 to 2.7 volts. In the depicted example, the green color channel is generally more sensitive over a larger range of voltages when compared to the red and blue color channels. For instance, as shown by curve 144, the green color channel exhibits greatest transmittance sensitivity over an applied voltage range of approximately 2.6 to 3.7 volts.

Before continuing, it should be understood that the depicted curves 132, 134, and 136 are intended to show an example of the voltage-transmittance characteristics that may be found in a display panel. Indeed, those skilled in the art will appreciated that the illustrated voltage-transmittance curves 132, 134, and 136, as well as their corresponding transmittance sensitivity curves 142, 144, and 146, may vary between different display panels depending, for example, on techniques and/or materials used in manufacturing and/or constructing a particular display panel.

Referring still to FIG. 6, graph 140 also depicts the gamma tap adjustment points 116 of FIG. 5, represented here by tap points G1-G5. While five tap points are provided, it should be understood that additional or fewer tap points may be provided in other implementations. Generally, conventional gamma adjustment architectures do not provide for independently adjustable gamma tap points for each color channel. That is, while gamma tap points G1-G5 may be utilized in separate resistor strings 110 for each color channel, the gamma tap points G1-G5 would be located at the same tap positions for each color channel of a display. In other words, gamma taps G1-G5 would be located at the same relative location in each gamma resistor string 110 utilized in a display device regardless of the transmittance sensitivity with respect to applied voltages for each individual color channel.

As will be appreciated, such an approach may not always provide accurate gamma correction and color output because the gamma taps G1-G5 may not necessarily be concentrated in areas of maximum sensitivity. For instance, referring now to FIG. 8, a conventional gamma adjustment circuit utilizing a separate resistor string 110*a*, 110*b*, and 110*c* for each color channel is illustrated. Though depicted as a simplified logic block, it should be appreciated that each resistor string 110*a*, 110*b*, and 110*c* may have a structure generally similar to the resistor string 110 shown in FIG. 5. Specifically, resistor string 110*a* corresponds to a red color channel, resistor string 110*b* corresponds to a green color channel, and resistor string 110*c* corresponds to a blue color channel of a display device.

Each of resistor strings 110*a*, 110*b*, and 110*c* may output a respective set of voltage levels, referred to here by the reference numbers 114*a*, 114*b*, and 114*c*. As mentioned above, the number of voltage output levels $V_1$-$V_2^N$ depends on the number of bits used to express a digital level value. For instance, referring to the example discussed in FIG. 5 in which 6 bits are used to represent a digital level value, a total of 64 output voltage levels ($V_1$-$V_{64}$) from each of resistor strings 110*a*, 110*b*, and 110*c* is provided. In the conventional gamma adjustment circuitry of FIG. 8, the output voltage levels 114*a* from the red color channel resistor string 110*a*, the output voltage levels 114*b* from the green color channel resistor string 110*b*, and the output voltage levels 114*c* from the blue color channel resistor string 110*c*, may collectively be received input signals 152 of multiplexer 150. That is, the multiplexer 150 may include $3\times2^N$ inputs, wherein each third of the inputs 152 correspond to output voltage levels of a particular color channel. Multiplexer 150 may also receive selection signals 154 and 156. Specifically, selection signal 154 may represent a selection input for a particular color channel, i.e., red, green, or blue. Selection signal 156 may provide digital level data corresponding to each respective unit pixel 32 of a row within panel 30, for instance. Thus, based on the values of selection signals 154 and 156, multiplexer 150 may select an appropriate output voltage value from inputs 152 to be sent to a display panel (e.g., to each source line 34), as indicated by multiplexer output signal 158.

Figure 8:
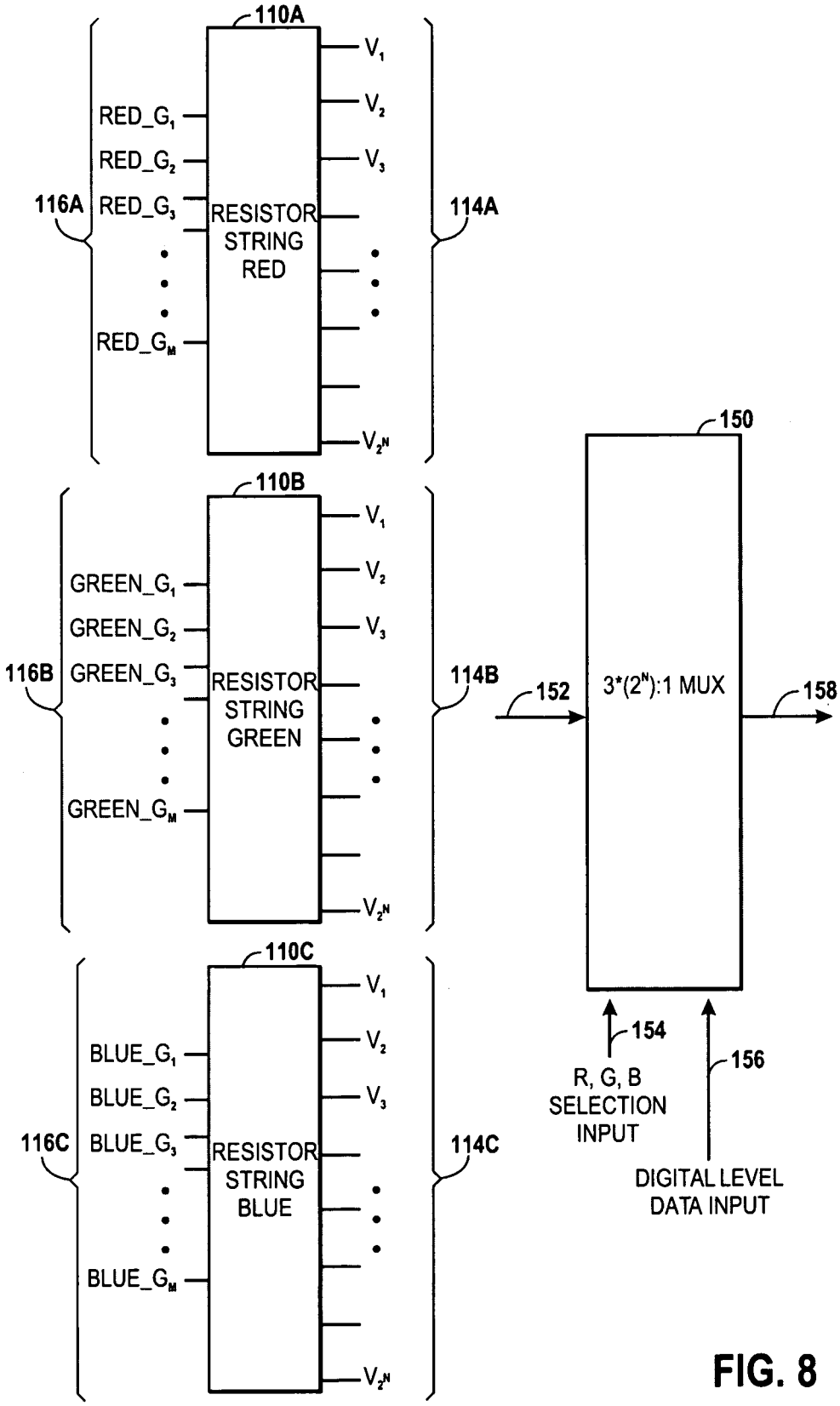
FIG. 8 is block diagram of conventional gamma adjustment circuitry that utilizes a separate gamma adjustment circuit for each of a plurality of color channels.

As discussed above with reference to FIG. 7, conventional gamma adjustment architectures, such as shown in FIG. 8, may provide for gamma adjustment points for each of resistor strings 110*a*, 110*b*, and 110*c*. For instance, gamma tap points for the red color channel resistor string 110*a* may include gamma tap points Red_$G_1$-Red_$G_M$, collectively referred to by reference number 116*a*. Similarly, the green color channel resistor string 110*b* may include gamma tap points Green_$G_1$-Green_$G_M$, collectively referred to by reference number 116*b*, and the blue color channel resistor string 110*c* may include gamma tap points Blue_$G_1$-Blue_$G_M$, collectively referred to by reference number 116*c*. Typically, the voltages provided by the gamma adjustment taps 116*a*, 116*b*, and 116*c* may be selected based upon transmittance sensitivity characteristics for each of the color channels. By way of example and with reference to graph 140 of FIG. 7, depending on the voltage applied by a gamma adjustment tap point, a sensitivity curve (e.g., 142, 144, or 146) may be pulled up or down at one of the applied voltage levels corresponding to a gamma tap location (G1-G5).

While the conventional gamma adjustment architecture shown in FIG. 8 does allow for independent sets of gamma adjustment voltages to be applied to each resistor string 110*a*, 110*b*, and 110*c*, such conventional architectures do not provide for the adjustability of the locations of the gamma tap points themselves. In other words, the gamma tap points 116*a* of resistor string 110*a*, the gamma tap points 116*b* of resistor string 110*b*, and the gamma tap points 116*c* of resistor string 110*c* are generally located at the same positions in each resistor string. For instance, if the red gamma tap applying the gamma adjustment voltage Red_$G_1$ is located at a digital level corresponding to the output voltage $V_2$, then the corresponding gamma voltages Green_$G_1$ of resistor string 110*b* and Blue_$G_1$ of resistor string 110*c* would also be located at the voltage output level $V_2$. As discussed above this type of gamma adjustment architecture may not always provide for accurate gamma correction and thus color output because the gamma taps for each respective color channel are not necessarily concentrated in the areas of greatest transmittance sensitivities.

Figure 9:
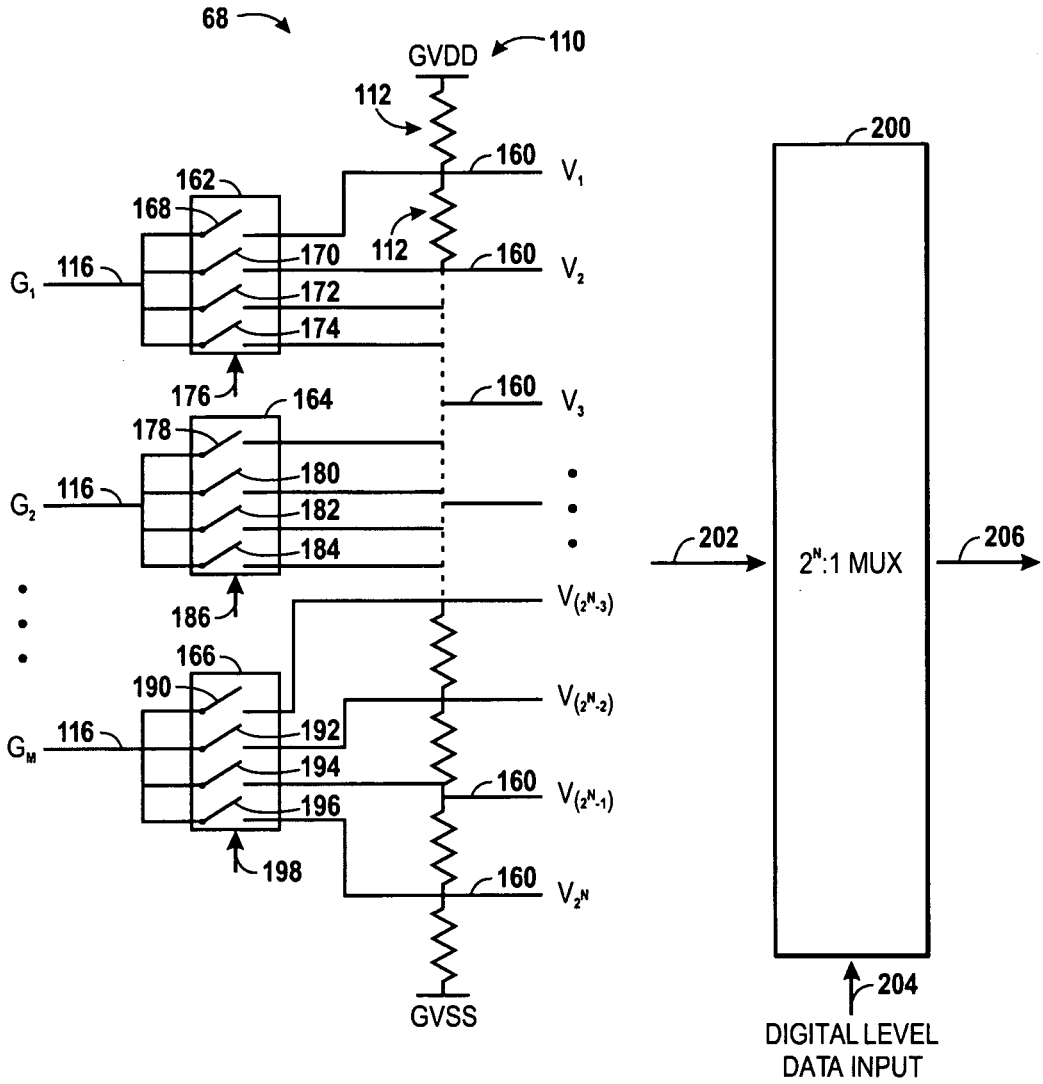
FIG. 9 is a circuit diagram illustrating a gamma adjustment circuit providing adjustable gamma tap locations, in accordance with aspects of the present disclosure.

Keeping the above-discussed aspects of conventional gamma adjustment techniques in mind, FIG. 9 depicts a gamma adjustment architecture implemented in accordance with aspects of the presently described techniques which may be provided in gamma correction circuitry 68 of gamma block 66 of source driver IC 48 shown in FIG. 3. Gamma adjustment circuitry 68 may include resistor string 110, which may include a plurality of resistors 112, as discussed above. Resistor string 110 may be utilized to produce all possible voltage levels $V_1$-$V_2^N$. As mentioned above, the number of output voltage levels $V_1$-$V_2^N$, collectively referred to here by reference number 160, may depend on the number of bits used to express a digital level value. By way of example, source driver IC 48 may utilize 6 bits, thus providing for 64 total output voltage levels, or in another embodiment, 8 bits providing for 256 total output voltage levels.

Additionally, as shown, gamma adjustment circuitry 68 may provide a number of gamma tap voltages $G_1$-$G_M$, by way of the gamma tap points 116. Here, in contrast to the conventional gamma architectures described above in FIGS. 5 and 8, gamma adjustment circuitry 68 includes a number of switching logic blocks that provides for the adjustability of the location of each gamma tap 116 with respect to resistor string 110. For instance, gamma tap voltage $G_1$ may be provided to switching logic block 162. Switching logic block 162 may include a plurality of switches, represented here by reference numbers 168, 170, 172, and 174. Similarly, the gamma tap providing gamma voltage $G_2$ may be provided to switching logic block 164, which may include the switches 178, 180, 182, and 184. As will be appreciated, each supplied gamma tap voltage $G_1$-$G_M$, may be supplied to a respective switching logic block. For instance, gamma tap $G_M$ may be provided to switching logic block 166, which includes switches 190, 192, 194, and 196. Although only switching logic blocks 162, 164, and 166 are illustrated in the present figure, it should be appreciated that depending on the number of gamma taps M provided to resistor string 110, a similar switching logic block may be provided for each gamma tap.

Each of switching logic blocks 162, 164, and 166, may receive respective control signals 176, 186, and 198. These control signals may serve to provide for the selection of one of the switches within the switching logic block. For example, referring to switching logic block 166 by way of example, depending on the state of control signal 198, switching circuit 190, 192, 194, or 196 may be selected, thus coupling the gamma tap voltage $G_M$ to a corresponding location on resistor string 110. For instance, if control signal 198 causes switch 190 to be selected, gamma adjustment voltage $G_M$ may be coupled to a location corresponding to the output voltage level $V_{2^N-3}$. If switch 192 is selected, gamma adjustment voltage $G_M$ may be coupled to a location corresponding to output voltage level $V_{2^N-2}$. Similarly, if switches 194 or 196 are selected, gamma adjustment voltage $G_M$ may be coupled to tap locations corresponding to output voltage levels $V_{2^N-1}$ and $V_{2^N}$, respectively. In other words, depending on the switch selected within a particular switching logic block, a corresponding gamma voltage input 116 may be coupled to various locations along resistor string 110. The output voltage levels 160 ($V_1$-$V_{2^N}$) may be received as input signal 202 by multiplexer 200. Based on selection signal 204, which may provide digital level data corresponding to each respective unit pixel 32 of a row within panel 30, for instance, appropriate voltages ($V_1$-$V_{2^N}$) received by multiplexer 200 may be selected and output to panel 30 (e.g., to each respective source line 34), as indicated by output signal 206.

Although the presently illustrated embodiment of FIG. 9 depicts each switching logic block (e.g., 162, 164, 166) as including four switches, it should be understood that in additional embodiments, the switching logic blocks may include more or fewer switches. Further, in some embodiments, each switching logic block may also include a different number of switches. For instance, a switching logic block that is located generally near a portion of resistor string 110 that corresponds to an area in which transmittance sensitivity for a particular color channel is greatest may include more switches in order to provide for a higher degree of adjustability with regard to gamma tap locations within the sensitive region. In one particular embodiment, a single gamma tap may be provided to a switching logic block that is configured to connect the adjustment voltage supplied by the gamma tap to any of the output points along resistor string 110. In other words, the switching logic block may include $2^N$ switches, one corresponding to each output level ($V_1$-$V_{2^N}$) of resistor string 110 and, based on a control signal supplied to the switching logic block, the gamma tap may be coupled to a corresponding output level. In yet a further embodiment, gamma adjustment circuit 68 may include a combination of both fixed gamma taps (e.g., as shown in FIG. 5) and adjustable gamma taps, as shown in FIG. 9 (e.g., using switching logic blocks).

Further, while the present embodiment, specifically with reference to switching logic block 166, shows each switch 190, 192, 194, and 196 as being configured to couple gamma voltage $G_M$ to one of four directly adjacent output voltage levels $V_{2^N-3}$, $V_{2^N-2}$, $V_{2^N-1}$, and $V_{2^N}$, respectively, it should be understood that in additional embodiments, the switches within a switching logic block need not necessarily be coupled to directly adjacent output voltage levels. By way of example only, in an alternate embodiment, switch 196 may be configured to couple gamma adjustment voltage $G_M$ to output voltage level $V_{2^N}$, switch 194 may be configured to couple gamma adjustment voltage $G_M$ to output level voltage $V_{2^N-3}$, switch 192 may be configured to couple $G_M$ to output voltage level $V_{2^N-5}$ (not shown), and switch 190 may be configured to couple voltage $G_M$ to output voltage level $V_{2^N-7}$ (not shown). Thus, by providing for the adjustability of gamma tap point locations within resistor string 110, the presently disclosed techniques may provide for improved and more accurate gamma correction, particularly when the illustrated architecture is applied to a plurality of color channels each having transmittance sensitivities that may be concentrated at voltages along resistor string 110.

Figure 10:
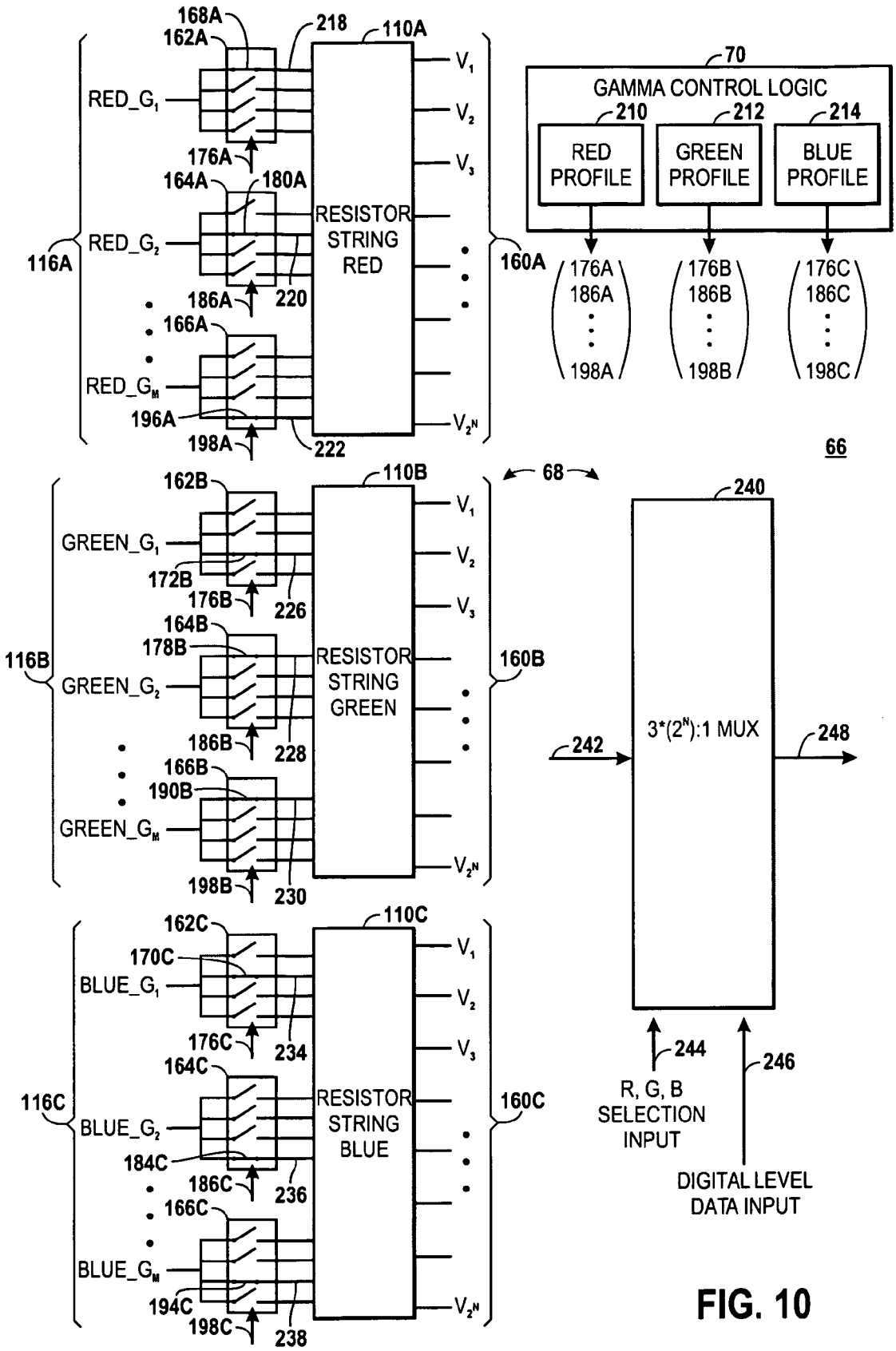
FIG. 10 is a circuit diagram of gamma adjustment circuitry that provides for adjustable gamma tap locations that may be configured independently with respect to each of a plurality of color channels in a display device, in accordance one embodiment of the present disclosure.

For example, continuing now to FIG. 10, an embodiment of gamma block 66 is illustrated in accordance with aspects of the present disclosure. The depicted gamma block 66 includes gamma adjustment circuitry 68 and gamma control logic 70. Gamma adjustment circuitry 68 may include separate gamma adjustment components for each color channel of display 28, such as a red, green, and blue color channel. For instance, gamma correction circuitry 68 includes resistor string 110*a*, which corresponds to a red color channel, resistor string 110*b*, which corresponds to a green color channel, and resistor string 110*c*, which corresponds to a blue color channel. Here again, although each of resistor strings 110*a*, 110*b*, and 110*c* are shown as a simplified logic block, it should be appreciated that each of these resistor strings may include a plurality of resistors 112, as shown in FIG. 9. Further, each of resistor strings 110*a*, 110*b*, and 110*c* may provide a plurality of voltage output levels 160*a*, 160*b*, and 160*c*, respectively.

Resistor strings 110*a*, 110*b*, and 110*c* may each include one or more gamma adjustment taps that may be independently adjusted for each color channel in order to select specific locations on a corresponding resistor string. For instance, red resistor string 110*a*, may receive gamma adjustment taps 116*a*, green resistor string 110*b* may receive gamma adjustment taps 116*b*, and blue resistor string 110*c* may received gamma adjustment taps 116*c*. As discussed above with reference to FIG. 9, the present architecture may utilize one or more switching logic blocks in conjunction with a given resistor string in order to provide for the adjustability of the locations along the resistor string to which gamma adjustment taps are connected. For instance, referring to red resistor string 110*a*, gamma adjustment voltage Red_$G_1$ is received by switching logic block 162*a*, which may receive control signal 176*a* to facilitate the selection of switch 168*a*. As shown, switch 168*a* may function to couple gamma adjustment voltage Red_$G_1$ to location 218 on resistor string

110*a*. Gamma adjustment voltage Red_$G_2$ may similarly be received as an input of switching logic block 164*a*, wherein switch 180*a* is selected based on control signal 186*a*, thus effectively selecting the location of the tap point providing gamma adjustment voltage Red_$G_2$ as being at location 220 of resistor string 110*a*. Additionally, gamma adjustment voltage Red_$G_M$ may be coupled to resistor string 110*a* at location 222, as determined by switch 196*a* of switching logic block 166*a* under control signal 198*a*.

As shown in the present embodiment, control signals 176*a*, 186*a*, and 198*a*, which govern the selection of switches within switching logic blocks 162*a*, 164*a*, and 166*a*, respectively, may be provided by gamma control logic 70. Particularly, values and/or data corresponding to control signals 176*a*, 186*a*, and 198*a* may be stored within gamma control logic 70, as indicated by block 210, referred to herein as "gamma correction profile." Thus, red gamma correction profile 210 may provide control signals to the switching logic blocks associated with red resistor string 110*a*, such that appropriate switches within the switching logic blocks are selected in order to provide for accurate gamma adjustment for the red color channel. For instance, control signals provided by red gamma correction profile 210 may be determined such that gamma adjustment voltages Red_$G_1$-Red_$G_M$ are suitably distributed at least at locations along resistor string 110*a* generally corresponding to greatest areas of transmittance sensitivity.

With the above description in mind, it should be appreciated that gamma adjustment circuitry corresponding to the green and blue color channels may operate in a similar manner as described with reference to the red color channel. For example, referring to the green color channel, green resistor string 110*b* may receive gamma adjustment voltage inputs Green_$G_1$-Green_$G_M$, collectively referred to here by reference number 116*b*. Each of the gamma adjustment voltages Green_$G_1$-Green_$G_M$ may be provided to respective switching logic blocks which may provide for adjustability of the location on resistor string 110*b* to which each gamma adjustment voltage Green_$G_1$-Green_$G_M$ is connected. For illustrative purposes, only switching logic blocks 162*b*, 164*b*, and 166*b*, which receive gamma adjustment voltages Green_$G_1$, Green_$G_2$, and Green_$G_M$, respectively, are shown. It should be appreciated, however, that depending on the number of gamma adjustment voltage taps (M), additional switching logic blocks may be utilized in conjunction with resistor string 110*b*.

Further, in a manner similar to the gamma adjustment circuitry associated with red resistor string 110*a* discussed above, switching logic block 162*b*, switching logic block 164*b*, and 166*b* may receive control signals 176*b*, 186*b*, and 198*b*, respectively. By way of these control signals, gamma adjustment voltage Green_$G_1$ may be coupled to location 226 on resistor string 110*b* via selection of switch 172*b*. Similarly, gamma adjustment voltage Green_$G_2$ may be coupled to location 228 of resistor string of 110*b* via selection of switch 178*b*, and gamma adjustment voltage Green_$G_M$ may be coupled to location 230 of resistor string 110*b* by way of the selection of switch 190*b*. Control signals 176*b*, 186*b*, and 198*b* may be stored as data represented by green gamma correction profile 212. Thus, control logic 70 may supply control signals 176*b*, 186*b*, and 198*b* to switching logic blocks 162*b*, 164*b*, and 166*b*, respectively, using green gamma correction profile 212 to facilitate selection of the appropriate switches in providing the desired gamma tap locations 226, 228, and 230.

Further referring to blue resistor string 110*c*, similar circuitry is provided with regard to gamma tap adjustment voltages Blue_$G_1$-Blue_$G_M$, collectively referred to here by reference number 116*c*. For instance, blue resistor string 110*c* may be coupled to switching logic blocks 162*c*, 164*c*, and 166*c*, each of which may receive control signals 176*c*, 186*c*, and 198*c*, respectively, based on blue gamma correction profile 214 stored in control logic 70. As shown in the present embodiment, the control of switching logic blocks 162*c*, 164*c*, and 166*c*, may result in the gamma adjustment voltage Blue_$G_1$ to be coupled to location 234 of resistor string 110*c* via selection of switch 170*c*. Additionally, gamma adjustment voltage Blue_$G_2$ may be coupled to location 236 on resistor string 110*c* via selection of switch 184*c*, and gamma adjustment voltage tap Blue_$G_M$ may be coupled to location 238 of blue resistor string 110*c* via the selection of switch 194*c*. Thus, as illustrated here, the presently disclosed architecture provides for the independent selection of locations along a resistor string at which gamma adjustment voltages for each color channel of display 28.

As mentioned above, gamma adjustment circuitry 68 further includes multiplexer 240. Multiplexer 240 may receive as input signal 242 the combination of output voltage levels 160*a* from resistor string 110*a*, output level voltages 160*b* from resistor string 110*b*, and output level voltages 160*c* from resistor string 110*c*. Multiplexer 240 may additionally receive selection signals 244 and 246. Selection signal 244 may correspond to selection of a particular color channel, such as the red, green, or blue color channel. Selection signal 246 may provide digital level data corresponding to each respective unit pixel 32 of a row within the panel 30, for instance. Thus, based on selection signals 244 and 246, an appropriate output voltage level may be selected and output to panel 30, (e.g., to source lines 34) as shown by output signal 248.

Before continuing, it should be understood that the presently illustrated embodiment having a red, green, and blue color channel is provided merely by way of example. In additional embodiments, other suitable color configurations may also be used. For instance, as discussed above, one such embodiment may utilize a red, green, blue, and white color channel configuration. In another embodiment, the present architecture may also be applied to a display utilizing a cyan, magenta, yellow, and black color configuration. Still further, it should be kept in mind, as discussed above with reference to FIG. 9, that each of the switching logic blocks shown in the present embodiment may not necessarily require the same number of switches. For instance, depending on the general location to which a switching logic block is coupled to a resistor string, the number of switches within the switching logic block may be increased or decreased depending on the transmittance sensitivity of the particular color channel. That is, in some embodiments, certain switching logic blocks may include more switches and be capable of coupling a corresponding gamma adjustment voltage to more locations along a resistor string than other switching logic blocks having fewer switches.

Still further, in yet another embodiment, a display architecture that may provide gamma correction for red, green, or blue (or additional colors) channels may be achieved using a single resistor string, such as illustrated in FIG. 9. Here, a time division multiplexing scheme may be utilized, such that during discrete time intervals, appropriate control signals are supplied to each of switching logic blocks 162, 164, and 166 to facilitate the selection of gamma adjustment points for either a red, green, or blue channel depending on the time interval. Such time division techniques will discussed in further detail below with respect to FIG. 14.

Figure 11:
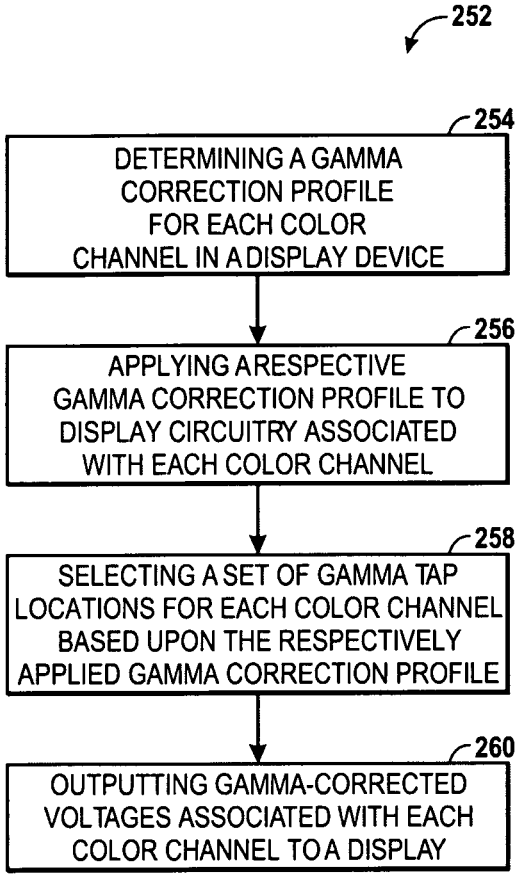
FIG. 11 is a flowchart illustrating a method for selecting gamma adjustment points for each of a plurality of color channels via applying a respective gamma correction profile for each color channel to the gamma adjustment circuitry of FIG. 10.

Continuing now to FIG. 11, a flow chart depicting a technique for selecting gamma adjustment tap locations for a plurality of color channels in a display device is illustrated, in accordance with aspects of the present disclosure. By way of example, the method, referred to here by reference number 252, may be applied in operating gamma adjustment circuitry 68 discussed above with reference to FIG. 10. The method 252 initially begins at step 254 in which a gamma correction profile is determined for each of a plurality of color channels utilized by a display device, such as display 28. As described above with reference to gamma control logic 70 shown in FIG. 10, a gamma correction profile, such as red, green, and blue gamma correction profiles 210, 212, and 214, respectively, may represent data that facilitates the selection of locations on a particular resistor string at which gamma adjustment voltage taps are applied. By way of example, red gamma correction profile 210 may be interpreted by control logic 70 as control signals that may be transmitted to switching logic blocks 162*a*, 164*a*, and 166*a* to provide for the selection of switches 168*a*, 180*a*, and 196*a*. Further, each gamma correction profile may also include data pertaining to the particular voltage values supplied to each gamma adjustment voltage tap associated with a particular color channel. For instance, based upon transmittance sensitivity data for each color channel, voltage values provided at gamma tap points may be selected accordingly, such as to pull up or pull down a sensitivity curve corresponding to a particular color at particular voltage locations.

Next, at step 256, method 252 may apply a respective gamma correction profile to display circuitry associated with each color channel. For instance, referring again to the embodiment shown in FIG. 10, step 256 may include providing the control signals associated with gamma correction profiles 210, 212, and 214 stored in the control logic 70 to corresponding switching logic blocks associated with each color channel. Additionally, in some embodiments, the application of a gamma correction profile may also include defining the voltage values to be supplied to gamma adjustment taps associated with each particular color channel. By way of example, with reference to red resistor string 110*a* of FIG. 10, in addition to providing control signals 176*a*, 186*a*, and 198*a* to switching logic blocks 162*a*, 164*a*, and 166*a*, respectively, the values for each of the gamma adjustment voltages Red_$G_1$-Red_$G_M$ may also be determined by red gamma correction profile 210.

Continuing now to step 258, based upon the gamma correction profile applied in step 256, a set of gamma tap locations for each color channel may be selected. As explained above, in the embodiment shown in FIG. 10 gamma tap locations may be selected based upon control signals sent to each of a plurality of switching logic blocks. Each switching logic block may include a plurality of switches, each of which are coupled to a respective output level voltage of a corresponding resistor string. Thus, depending on the switch selected, a corresponding gamma adjustment voltage may be coupled to a location on the resistor string that corresponds to an output level voltage associated with the selected switch. Thereafter, method 252 concludes at step 260, wherein gamma-corrected output level voltages associated with each color channel are output to a display. As will be appreciated, step 260 may include the selection of a particular output level voltage by a selection circuit, such as multiplexer 240 shown in FIG. 10.

As explained above, one benefit of the presently disclosed independent gamma adjustment techniques is that the location of the gamma adjustment points may be individually selected for each color channel. Thus, compared to the conventional gamma correction circuitry discussed above with reference to FIGS. 5 and 8, in which the locations of gamma adjustment points are located at the same relative locations for each resistor string corresponding to the red, green, and blue color channels, gamma adjustment circuitry implementing the presently disclosed techniques provide for gamma adjustment voltages at locations in which each color channel exhibits a generally high degree of transmittance sensitivity, thus providing for more accurate adjustment of gamma characteristics for each individual color channel, and thus more accurate overall color output by the display.

Figure 12:
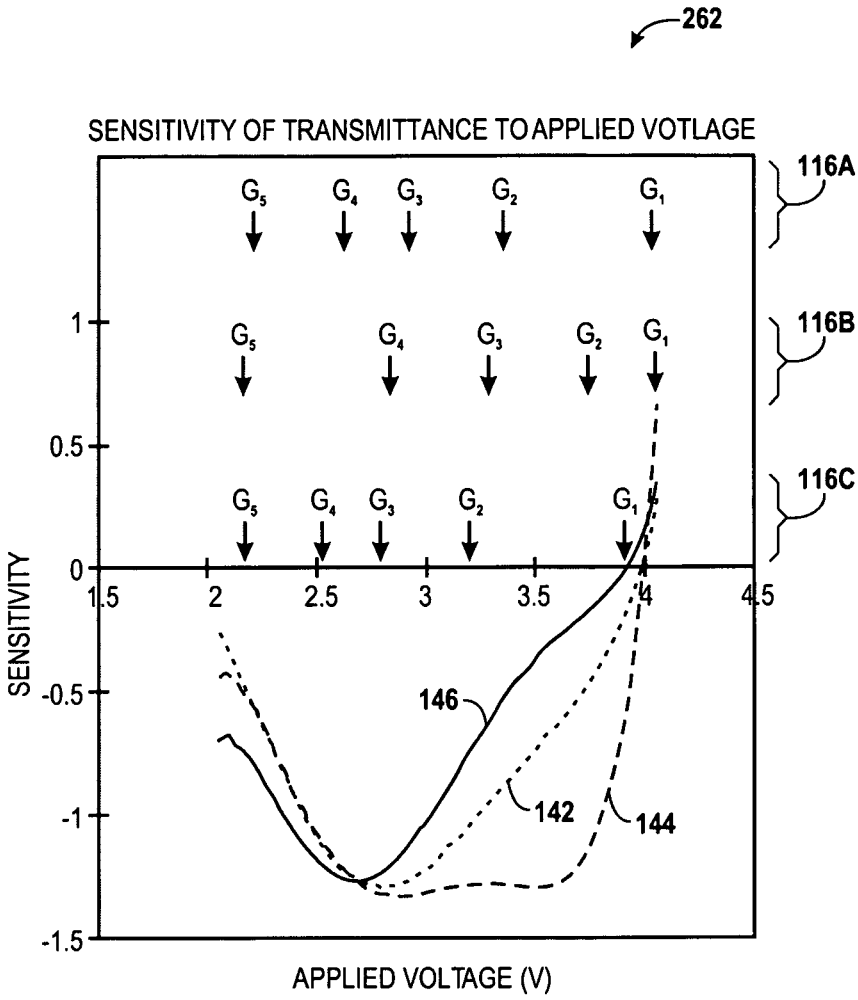
FIG. 12 is a graph showing transmittance sensitivity curves for each of a plurality of color channels as well as independent gamma adjustment points corresponding to each of the color channels, in accordance with aspects of the present disclosure.

These benefits are better illustrated with reference to FIG. 12, which illustrates graph 262 showing transmittance sensitivity curves 142, 144, and 146 corresponding to red, green, and blue color channels, respectively, as discussed above with reference to FIG. 7. Graph 262 further illustrates the selection of particular gamma tap locations associated with each of the illustrated red, green, and the blue color channels, referred to here by reference numbers 116*a*, 116*b*, and 116*c*, respectively. As will be explained below, the gamma tap locations for each of the color channels may be selected such that at least a portion of the gamma taps are generally concentrated in areas where a particular color channel has a greatest degree of transmittance sensitivity. For instance, referring first to curve 142, which represents the transmittance sensitivity of the red color channel, gamma tap locations 116*a* may include taps $G_1$ and $G_5$. As will be discussed further below, these points represent the maximum and minimum locations, respectively, of the gamma adjustment points, but may not necessary represent the maximum and minimum voltage of the curves. In embodiments, $G_1$ and $G_5$ may be selected in order to achieve a target white balance characteristic. For instance, if a "warm" white balance is desired, the tap locations may be selected such that a white color on a panel has warmer tones or tints (e.g., pink, orange, or yellow, etc.). If a "cooler" white balance is desired, the tap locations may be selected such that a white color on a panel has cooler tones (e.g., blue, green, etc.). As illustrated by curve 142, the red color channel exhibits the greatest transmittance sensitivity at approximately 2.6 to 2.8 volts. Accordingly, locations $G_3$ and $G_4$ of gamma taps 116*a* may be generally distributed within this particularly sensitive region of the red color channel. Location $G_2$ is further selected within a sloping region of curve 142 between the sensitive region (2.6-2.8 volts) and the maximum applied voltage value (approximately 4 volts).

Referring now to green transmittance sensitivity curve 144 and its corresponding gamma adjustment locations 116*b*, it can be seen that in addition to gamma taps $G_1$ and $G_5$, which represent the maximum and the minimum gamma adjustment points, remaining gamma tap locations $G_2$, $G_3$, and $G_4$ are generally distributed over the region of greatest transmittance sensitivity from approximately 2.6 to 3.7 volts. Further, referring to blue transmittance sensitivity curve 146, corresponding gamma tap locations 116*c* include tap locations $G_1$ and $G_5$ corresponding to the maximum and the minimum gamma adjustment points (e.g., selected based upon white balance requirements). Additionally, as illustrated by curve 146, the blue color channel exhibits the greatest transmittance sensitivity at approximately 2.5 to 2.7 volts. Accordingly, gamma tap locations 116*c* may include tap locations $G_3$ and $G_4$ distributed within this sensitive voltage range. Gamma tap locations 116*c* may further include location $G_2$ generally located within a sloping region between the maximum applied voltage and the region of sensitive voltage values.

Before continuing, it should be noted that the present graph 262 depicts five gamma tap locations for each color channel merely for illustrative purposes. As explained above, fewer or more gamma tap locations may be applied to specific colors depending on characteristics of the sensitivity curves shown herein. For instance, with reference to the green transmittance sensitivity curve 144, which displays a larger voltage range over which the green color channel is particularly sensitive relative to curves 142 and 146 of the red and blue color channels, respectively, it may be desirable in some embodiments to provide additional gamma tap locations within the particularly sensitive region (e.g., from approximately 2.6 volts to 3.7 volts). By way of example only, in one embodiment in which 6 bits are used in expressing digital levels (e.g., 64 total output voltage levels), 5 tap locations may be provided for the red and blue color channels, and 10-13 tap locations may be provided from the more sensitive green color channel. Again, it should be noted that the specific curves shown in graph 262 are provided merely by way of example, and that transmittance sensitivity characteristics may vary between different panels from different manufacturers, for instance.

Figure 13:
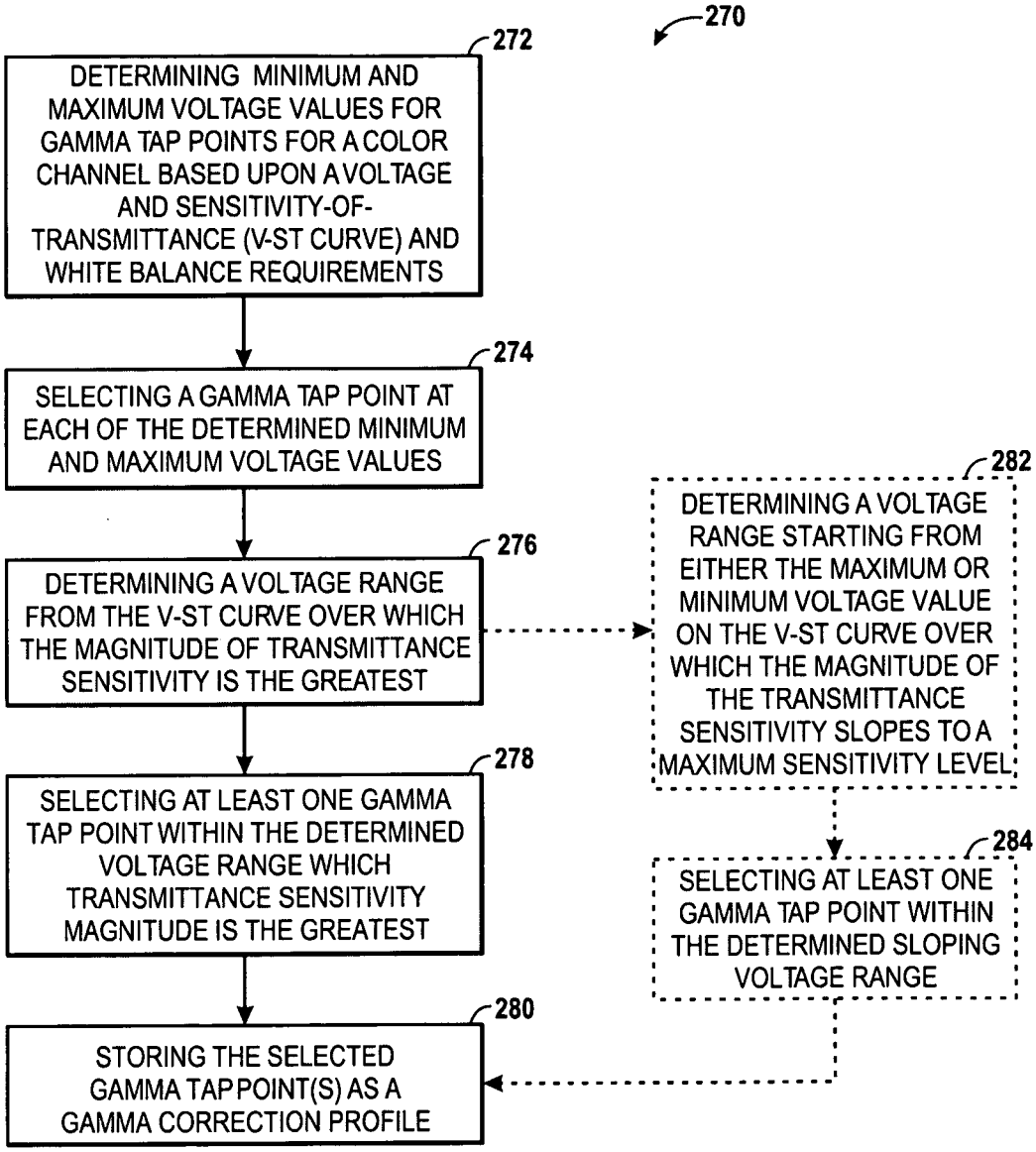
FIG. 13 is a flowchart depicting a method for selecting gamma tap points for a particular color channel, in accordance with aspects of the present disclosure.

Techniques for selecting appropriate gamma tap locations for each color channel are generally illustrated by method 270 shown in FIG. 13. Method 270 begins at step 272, in which a minimum and a maximum value for gamma taps to be applied to a color channel are first determined. For instance, as mentioned above, the maximum and minimum gamma tap locations may be determined by observing a transmittance sensitivity curve of each color channel, such as the curves shown in graph 262 in FIG. 12 and selecting the appropriate tap locations to achieve a particular white balance on a panel. Next, at step 274, a gamma tap point may be selected at locations corresponding to each of the determined voltage values from step 272. For instance, referring to graph 262, gamma tap locations 116*a* corresponding to the red color channel, respectively, may each include gamma tap locations $G_1$ and $G_5$.

Next, at step 276, a range of applied voltages over which each color channel exhibits greatest transmittance sensitivity is determined. For instance, with regard to red transmittance sensitivity curve 142, the red color channel exhibits the greatest sensitivity of transmittance at voltages of approximately 2.6 to 2.8 volts. With regard to the green color channel, as shown by curve 144, transmittance sensitivity is the greatest over applied voltages ranging from approximately 2.6 volts to approximately 3.7 volts. Similarly, with regard to blue transmittance sensitivity curve 146, the greatest sensitivity occurs at voltages of approximately 2.5 to 2.7 volts.

Continuing to step 278, at least one gamma tap point may be selected to correspond to a location that falls within the voltage ranges determined in step 276. As will be appreciated, the number of selected tap locations may be proportionately increased based upon the range over which transmittance sensitivity is generally high. For instance, as discussed above with reference to FIG. 12, curves 142 and 146 corresponding to the red and blue color channels, respectively, may exhibit greatest transmittance sensitivity over relatively small voltage ranges (e.g., approximately 0.2 volts). For instance, with regard to curve 142, the determined voltage range over which transmittance sensitivity of the red color channel is greatest occurs at approximately 2.6 to 2.8 volts. The blue color channel has generally similar transmittance sensitivity characteristics and exhibits greatest transmittance sensitivity from approximately 2.5 to 2.7 volts. To contrast, curve 144 corresponding to the green color channel exhibits a high degree of transmittance sensitivity over a relatively larger voltage range from approximately 2.6 to 3.7 volts.

Based on the above-determined ranges, the red color channel may include tap locations $G_3$ and $G_4$ of gamma tap locations 116*a* distributed within its respective region of high transmittance sensitivity. Similarly, blue gamma tap points 116*c* may also include gamma tap locations G3 and G4 generally distributed within the region of curve 146 that exhibits the highest transmittance sensitivity. Additionally, because green transmittance sensitivity curve 144 has a larger voltage range over which the green color channel exhibits high transmittance sensitivity, gamma tap points 116*b* may include gamma taps G2, G3, and G4 distributed within this range. In other words, more gamma tap locations may be selected as the voltage range corresponding to high transmittance sensitivity increased, such that at least a portion of gamma tap locations are generally concentrated within the sensitive voltage range. By way of example, instead of using five tap locations $G_1$-$G_5$, as shown by the tap points 116*b* in FIG. 12, additional tap points may be distributed within the sensitive region (approximately 2.6 to 3.7 volts) of curve 144. By way of example only, in a further embodiment, the green color channel may utilize six, seven, eight, or more tap locations, in which a majority of the tap locations are distributed within the sensitive region of curve 144.

Once appropriate gamma tap locations are determined for each color channel of display 28, method 270 continues to step 280, wherein the locations (e.g., 116*a*, 116*b*, 116*c*) may be stored as gamma correction profiles corresponding to each color channel. As discussed above with reference to FIG. 10, gamma correction profiles 210, 212, and 214 may be stored within control logic 70 and may be interpreted by control logic 70 to provide appropriate control signals to gamma adjustment circuitry 68 to facilitate selection of the appropriate gamma tap locations for each color channel.

Method 270 may optionally include steps 282 and 284, which may be carried out in parallel with steps 276 and 278. Steps 282 and 284 generally describe the selection of gamma tap locations for a color channel at voltages along a transmittance sensitivity curve other than those corresponding to the regions of highest sensitivity. At step 282, a determination is made with regard to voltage ranges corresponding to a sloping region of a transmittance sensitivity curve that extends from a region of high sensitivity to either a minimum or maximum voltage value, as determined by steps 276 and 278 discussed above. At step 284, a gamma tap location may be selected within the sloping region determined at step 282. Step 284 may then continue to step 280, in which the determined gamma tap locations may similarly be stored within a gamma correction profile. To provide an example, referring to the red sensitivity curve 242 shown in FIG. 12, the sloping region determined at step 282 may correspond to the sloping region from approximately 2.8 volts to 4 volts, and the selection of gamma tap location $G_2$ of the set of gamma tap locations 116*a* may correspond to step 284 of method 270.

Thus, it should be appreciated that in accordance with the gamma adjustment techniques disclosed herein, the selection of a set of gamma tap locations for each color channel of display 28 may include selecting voltage values that correspond to minimum and maximum gamma tap points for a color channel and selecting one or more tap locations falling within a voltage range over which a respective color channel exhibits highest transmittance sensitivity. In some instances, one or more additional tap locations may be selected within a voltage range corresponding to a sloping region of a transmittance sensitivity curve that extends from a region of high sensitivity to either a minimum or maximum voltage value (e.g., red tap location $G_2$ and blue tap location $G_2$).

In certain embodiments, it should be appreciated that method 270 may be performed using instructions stored as a computer program product on one or more machine or computer readable medium, such as a hard-disk, optical disk, programmable memory device, and so forth. That is, the instructions stored on the machine-readable medium may constitute executable routines that may be adapted to carry out the selection of gamma tap locations for each color channel via analysis of transmittance sensitivity curves. For instance, in some embodiments, the instructions may be configured to carry out the selection steps described above in method 270 based at least partially on empirical data. Further, in one embodiment, the instructions may be stored as part of a set of firmware that controls display 28 and its various components, including source driver IC 48. Additionally, such instructions may also be configured, in certain embodiments, to derive transmittance sensitivity characteristics for one or more color channels based at least partially upon voltage-transmittance data, such as depicted by graph 130 of FIG. 6.

While the embodiments discussed above, primarily with respect to FIG. 10, provide for a greater degree of gamma tap location adjustability of each color channel within display 28 relative to those of the conventional gamma adjustment circuits discussed above in FIGS. 5 and 8, the robustness of the adjustability of gamma tap locations may still limited by the number of voltage output levels on a given resistor string to which switching logic is connected. For example, referring to resistor string 110*a* of FIG. 10, each of the switches within switching logic block 162*a* may couple gamma adjustment voltage Red_$G_1$ to a respective output voltage level. If switching logic block 162*a* is coupled to output voltages $V_1$-$V_4$, for example, the gamma tap locations at which voltage Red_$G_1$ may be applied are adjustable, but are limited to the selection of either output levels $V_1$, $V_2$, $V_3$, or $V_4$ depending upon the state of control signal 176*a*, as discussed above. In some instances, it may be desirable to provide for an even greater degree of adjustability with regard to gamma tap locations.

Figure 14:
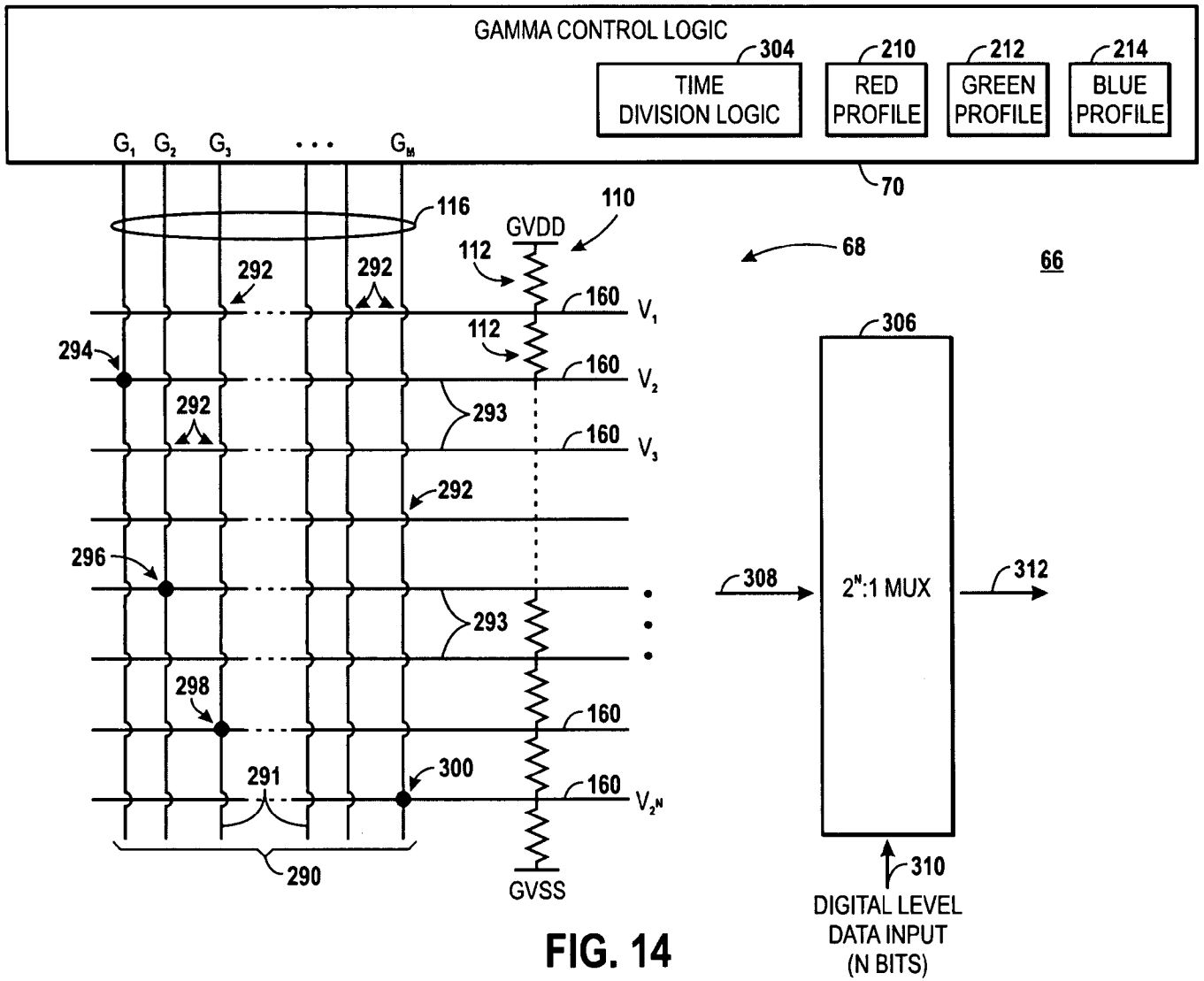
FIG. 14 is a circuit diagram of gamma adjustment circuitry that provides for independent gamma adjustment for each of a plurality of color channels in a display device, in accordance with a further embodiment of the present disclosure.

Turning now to FIG. 14, a further embodiment of gamma block 66 of source driver IC 48 shown in FIG. 3 is illustrated. In the illustrated embodiment, instead of utilizing a separate resistor string for each color channel, as shown in the earlier embodiment of FIG. 10, gamma adjustment circuitry 68 provides output voltage levels for each color channel (e.g., red, green, and blue) of display 28 using a single resistor string 110 having a plurality of resistors 112. In operation, each color channel may share voltage outputs 160 (including $V_1$-$V_2^N$) using a time division multiplexing scheme. Using a time division multiplexing scheme, output voltages corresponding to the red, green, and blue color channels are physically provided at different times under the control of time division logic 304, which may be a component of gamma control logic 70, as shown in the present embodiment, or may be a separate component within gamma block 66. Time division logic 304 may be configured to divide the operational time domain into discrete timeslots of fixed length. Thus, output voltage levels 160 from resistor string 110 corresponding to each of the color channels may be output at different timeslots during operation of display 28. For instance, output voltage levels 160 associated with the red, green, and blue color channels may be output from resistor string 110 during a first, second, and third timeslots, respectively. Following the third timeslot, the process may repeat, whereby output voltage levels 160 for the red, green, and blue color channels are output at fourth, fifth, and sixth timeslots, respectively, and so forth. As will be appreciated, the illustrated arrangement utilizing only a single resistor string may reduce the amount of circuitry and logic required to implement gamma adjustment for multiple color channels, thereby reducing the cost and complexity of gamma adjustment circuitry within display 28.

Further, gamma adjustment circuitry 68 of the present embodiment may also provide for a greater range of gamma tap location adjustability compared to the embodiment discussed above in FIG. 10. As illustrated, resistor string 110 may be coupled to a matrix of switches, generally referred to by reference number 290. Switching matrix 290 includes wires or conductors 291, each coupled to a respective one of gamma adjustment voltages 116 ($G_1$-$G_M$), which may be provided by gamma control logic 70. Switching matrix 290 also includes wires or conductors 293, each coupled to a respective one of output voltage level points 160 ($V_1$-$V_2^N$) on resistor string 110. At each intersection of wires 291 and 293, a respective switch 292 may be provided to couple a corresponding gamma adjustment voltage to a corresponding output voltage level associated with a location on resistor string 110. Accordingly, depending on a particular color channel of which output voltage levels are being provided and based upon the application of a respective gamma correction profile (e.g., 210, 212, 214), appropriate switches 292 may be selected to apply gamma adjustment voltages $G_1$-$G_M$ to locations along resistor string 110 corresponding to a selected gamma correction profile. For example, referring to the time division scheme discussed above, if output voltages 160 corresponding to the red color channel are provided during a first timeslot, red gamma correction profile 210 may be selected. For illustrative purposes only, red gamma correction profile 210 may cause control logic 70 to select switches 294, 296, 298, and 300 within switching matrix 290. For instance, the selection of switch 294 may result in gamma adjustment voltage $G_1$ being applied to a location on resistor string 110 corresponding to output voltage $V_2$. Similarly the selection of switch 300 may result in gamma adjustment voltage $G_M$ being applied to a location on resistor string 110 corresponding to output voltage $V_2^N$. The selection of switches 296 and 298 may similarly couple gamma adjustment voltages $G_2$ and $G_3$ to respective locations (not labeled) on resistor string 110.

Gamma adjustment circuitry 68 additionally includes multiplexer 306, which may receive output voltage levels 160 from resistor string 110, as represented by input signal 308. Based on selection signal 310, which may provide digital level data corresponding to each respective unit pixel 32 of a row within the panel 30, for instance, a corresponding voltage from input signal 308 may be selected and output to panel 30, as indicated by multiplexer output 312. As will be appreciated, the selection of switches 294, 296, 298, and 300 may correspond to gamma tap locations defined by red gamma correction profile 210 based upon the transmittance sensitivity of the red color channel, as discussed above. Further, as will be understood, at the end of the first timeslot, a subsequent gamma correction profile, such as green gamma correction profile 212, may be applied, and selected switches 294, 296, 298, and 300 may be at different locations within the matrix 290 depending on the gamma adjustment tap locations defined by green gamma correction profile 212. Thus, based upon the control of time division logic 304, output 312 from multiplexer 306 may correspond to a selected voltage level from the red, green, and blue color channels. For instance, during the first timeslot mentioned above, the output 312 may represented voltages selected based upon voltage outputs of resistor string 110, which may include gamma adjustment tap locations selected based upon red gamma correction profile 210, as discussed above. During subsequent timeslots, output 312 may represent voltages selected from either blue or green color channels.

When compared to the embodiment discussed above which may include a single switching logic block configured to couple a single gamma tap location to each voltage output level on a resistor string, the present embodiment, "full" adjustability of the gamma tap locations applied to resistors string 110 is provided. That is, the present embodiment provides a one-to-one mapping in which each of the gamma adjustment voltages $G_1$-$G_M$ may be applied to tap locations along the entire resistor string 110. For instance, gamma adjustment voltage $G_1$, depending on which switch 292 is selected in the corresponding wire 291, may be coupled to tap locations corresponding to any one of output voltage levels $V_1$-$V_2^N$ along resistor string 110. Thus, the present embodiment provides for an even greater degree of gamma tap location adjustability compared to the embodiment shown in FIG. 10. Additionally, it should be understood that in further embodiments, the size of switching matrix 290 may be reduced by limiting possible connection points for each gamma voltages. By way of example, if certain color channels exhibit similar transmittance sensitivity characteristics at higher applied voltages, such as shown by curves 142 and 146 (FIG. 12) corresponding to the red and blue color channels, respectively, switching matrix 290 may reduce adjustability of gamma taps by providing fewer switches 292 within the higher voltage ranges. However, while a reduction in the number of switches 292 may reduce the complexity of gamma adjustment circuitry 68, it should be borne in mind that at least a sufficient number of switches 292 should be implemented over sensitive regions of the green color channel (e.g., approximately 2.6 to 3.7 volts, as shown on curve 146) such that gamma adjustment circuitry 68 still provides at least a flexible degree of gamma tap location adjustability with regard to the green color channel within this region.

Figure 15:
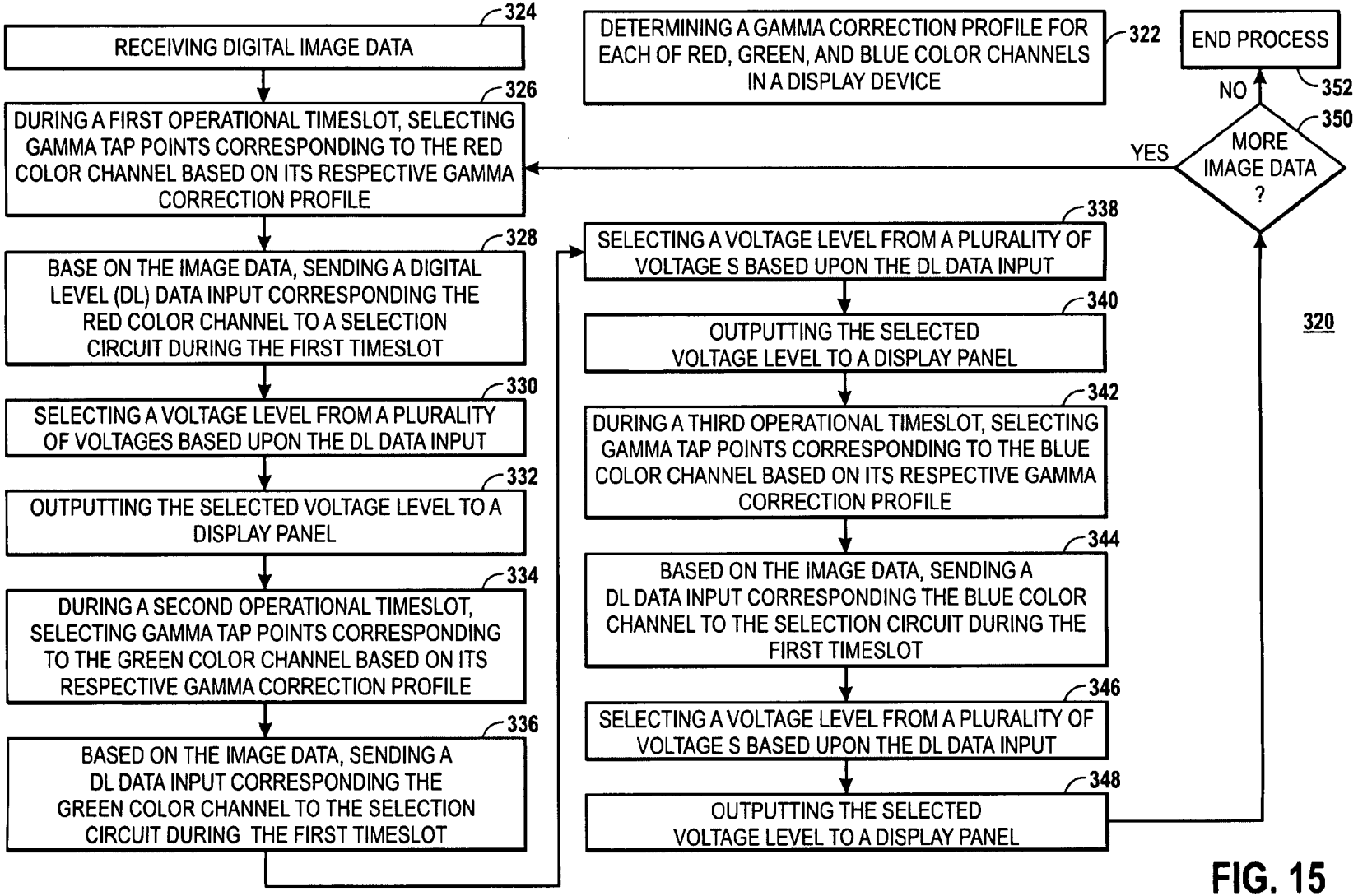
FIG. 15 is a flowchart illustrating a method for adjusting gamma characteristics for each of a plurality of color channels by applying a respective gamma correction profile for each color channel to the gamma adjustment circuitry of FIG. 14.

The operation of the embodiment of gamma block 66 described above in FIG. 14 may be better understood with reference to method 320 illustrated by FIG. 15. Beginning at step 322, gamma correction profiles for each of a plurality of color channels utilized by a display device are determined. These gamma correction profiles may be determined using any of the techniques discussed above, particularly with reference to the selection of gamma tap locations along a resistors string, as shown by method 270 of FIG. 13. The gamma correction profiles may be utilized by gamma control logic 70, for instance, to provide for independently adjustable gamma tap locations during operation of source driver IC 48, thereby providing for improved accuracy with regard to color output on display panel 30 from the viewpoint of a user.

Once the gamma correction profiles for each color channel of a display device are determined, method 320 continues to step 324, wherein digital image data (e.g., image data 52) representative of an image is received by source driver IC 48 of display device 28. Source driver IC 48, in conjunction with gate driver 50, may process the received image data to generate appropriate voltage signals to output to panel 30 in order to drive unit pixels 32 for creating a viewable image.

As discussed above, gamma block 66 of FIG. 14 may utilize time division multiplexing such that a single resistor string 110 may be used to supply the necessary output voltage levels for all color channels utilized by display 28. The time division multiplexing scheme (e.g., controlled by logic 304) may divide the time domain into a plurality of discrete timeslots, such that output voltage levels corresponding to each of the red, green, and blue color channels may be outputted from resistor string 110 at every third timeslot in a repeatedly alternating manner. For example, continuing to step 326, during a first timeslot, a set of gamma adjustment tap points may be selected based upon red gamma correction profile 210, as discussed above. Next, at step 328, output voltage levels from resistor string 110, which may include gamma adjustment voltages at the selected tap locations corresponding to red gamma correction profile 210, may be provided to a selection circuit, such as multiplexer 306. The selection circuit may receive a selection signal or control signal corresponding to a digital level data input corresponding to the red color channel of the image data being processed. Thereafter, at step 330, an appropriate output voltage level may be selected based upon a digital level data input received by the selection circuit. The selected voltage may then be provided to panel 30, as indicated by step 332.

Following the conclusion of the first timeslot, a subsequent set of gamma adjustment tap points may be selected based upon green gamma correction profile 212, as discussed above and shown at step 334. Thereafter, method 320 may proceed to steps 336-340, which are generally similar to the above-discussed steps 328-332. For instance, at step 336, output voltage levels from resistor string 110 that include gamma adjustment voltages at selected tap locations corresponding to green gamma correction profile 212, are provided to the selection circuit. The selection circuit may receive a selection signal or control signal corresponding to a digital level data input corresponding to the green color channel of the image data being processed. Thereafter, at step 338, an appropriate voltage output level may be selected based upon a digital level data input received by the selection circuit. Thereafter, the selected voltage corresponding to the green color channel may be provided to panel 30, as indicated by step 340.

Next, following the conclusion of the second timeslot, a further set of gamma adjustment tap points may be selected based upon blue gamma correction profile 214, as discussed above and shown at step 342. Method 320 may then proceed to steps 344-348, which are generally similar to the above-discussed steps 328-332 and steps 336-340. For instance, at step 344, output voltage levels from resistor string 110 that include gamma adjustment voltages at selected tap locations corresponding to blue gamma correction profile 214, are provided to the selection circuit. The selection circuit may receive a selection signal or control signal corresponding to a digital level data input corresponding to the blue color channel of the image data being processed. Next, at step 346, an appropriate voltage output level may be selected based upon a digital level data input received by the selection circuit. The selected voltage corresponding to the blue color channel may then be provided to panel 30, as indicated by step 348. Thereafter, method 320 may proceed to decision logic 350, at which a determination is made as to whether there is additional image data to be processed by source driver IC 48. If no additional image data is present for processing, then method 320 concludes at step 352. If there remains additional image data to be processed, then method 320 may repeat steps 326-348.

It should be understood that the use of three color channels (red, green, and blue) is provided in the present embodiment merely by way of example, and that display 28, in other embodiments, may utilize different color configurations, as briefly mentioned above. For instance, in a display utilizing red, green, blue, and white color channels, (RGBW display) the time division multiplexing scheme discussed above may output voltage levels corresponding to each color channel at every fourth timeslot in a repeating alternating manner.

It should be understood that the techniques set forth in the present disclosure are not intended to be limited to the particular forms disclosed. Rather, the techniques cover all modifications, equivalents and alternatives falling within the spirit and scope of the disclosure and claims.

What is claimed is:

1. A display device, comprising a display panel comprising a plurality of unit pixels defining a viewable region of the display device and having a plurality of color channels, each of the plurality of color channels having an associated gamma correction profile; and a source driver integrated circuit (IC) configured to process an image data stream and to transmit the processed image data to the display panel, wherein the source driver IC comprises:

gamma adjustment circuitry comprising:

a plurality of resistor strings, each corresponding to a respective one of the plurality of color channels, wherein each resistor string is configured to provide a plurality of output voltage levels corresponding to a respective color channel;

a plurality of sets of gamma adjustment voltage taps, each set of voltage taps corresponding to a respective one of the plurality of resistor strings, wherein each gamma adjustment voltage tap within a set is configured to be adjustably coupled to a respective location on a respective resistor string based upon a gamma correction profile configured to define a set of gamma adjustment locations along the respective resistor string to which each of a corresponding set of gamma adjustment voltage taps are coupled, wherein each respective set of gamma adjustment locations is determined based at least in part on transmittance sensitivity characteristics that corresponds to a transmittance versus voltage curve for the respective color channel, and wherein each respective set of gamma adjustment locations along the respective resistor string is determined by substantially optimizing a portion of the set of gamma adjustment locations to concentrate in a voltage range that corresponds to an area comprising a maximum absolute value of the transmittance sensitivity characteristics for the respective color channel; and a selection circuit configured to receive the plurality of output voltage levels provided by each of the resistor strings, to select one of the output voltage levels based upon one or more selection signals, and to output the selected voltage level to the display panel.

2. The display device of claim 1, wherein each gamma adjustment voltage tap is provided as an input to a respective switching logic block, wherein each switching logic block comprises a plurality of switches, each switch being coupled to a respective location on the respective resistor string, and wherein each switching logic block is configured to select one of its respective plurality of switches based upon a respective control signal provided based upon the gamma correction profile associated with the color channel corresponding to the respective resistor string.

3. The display device of claim 1, wherein a number of the plurality of output voltage levels provided by each resistor string is $2^N$, wherein N is the number of bits used to express a digital level for each color channel of the image data stream.

4. The display device of claim 1, wherein a number of voltage taps in each set of the plurality of sets of gamma adjustment voltage taps are adjustably coupled to the respective location on the respective resistor string vary based at least partially upon a range of voltages that corresponds to a range of maximum absolute values along the transmittance sensitivity characteristics of its corresponding color channel.

5. The display device of claim 1, wherein the unit pixels of the display panel are arranged in groups of three unit pixels, wherein each unit pixel within a group has an associated color characteristic based upon a respective color filter element, wherein each group of three unit pixels comprises a first unit pixel having a red color filter, a second unit pixel having a green color filter, and a third unit pixel having a blue color filter.

6. The display device of claim 1, wherein the set of gamma adjustment locations is adjustably coupled to the plurality of sets of gamma adjustment voltage taps at any node along the respective resistor string.

7. The display device of claim 6, wherein each node along the resistor string is positioned between two respective resistors of a plurality of resistors along the resistor string.

8. An integrated circuit, comprising:

an input bus for receiving an image data stream having image data corresponding to a plurality of color channels; and a gamma processing block comprising:

gamma adjustment circuitry comprising:

a resistor string defining a plurality of voltage level outputs;

a switching matrix comprising a first set of conductors coupled to each of the voltage level outputs from the resistor string, a second set of conductors coupled to each of a plurality of gamma adjustment voltage taps, and a plurality of switches comprising a switch located at each intersection of a conductor from the first set and a conductor from the second set, wherein each switch, when operating in a closed state, is configured to couple a gamma adjustment voltage corresponding to the wire from the second set to a voltage level output of the resistor string output coupled to the wire from the first set; and a selection circuit configured to receive and select one of the voltage level outputs from the resistor string based upon a selection signal comprising a digital level representation of the image data being processed and to output the selected voltage level output from the gamma processing block;

gamma control logic comprising:

a memory configured to store a gamma correction profile for each color channel, wherein each gamma correction profile defines a set of switches within the switching matrix corresponding to desired gamma adjustment locations for its respective color channel, the desired gamma adjustment points being determined based at least in part on a range of voltages that corresponds to a range of maximum values along a transmittance sensitivity curve for each respective color channel, wherein the desired gamma adjustment points are substantially optimized to concentrate a portion of the gamma adjustment points in the range of maximum values along the transmittance sensitivity curve for each respective color channel;

time division logic configured to implement a time division multiplexing scheme in which image data corresponding to each of the color channels is selected and processed in consecutive discrete timeslots, wherein during each timeslot, gamma adjustment points corresponding to a selected color channel are determined by selecting one or more switches within the switching matrix based upon the gamma correction profile associated with the selected color channel, wherein the discrete timeslots repeat in an alternating manner.

9. The integrated circuit of claim 8, wherein the color channels comprise first, second, and third channels, wherein a first set of switches defining a first set of gamma adjustment locations on the resistor string is selected based upon a first gamma correction profile corresponding to the first color channel during a first timeslot, wherein a second set of switches defining a second set of gamma adjustment locations on the resistor string is selected based upon a second gamma correction profile corresponding to the second color channel during a second timeslot, and wherein a third set of switches defining a third set of gamma adjustment locations on the resistor string is selected based upon a third gamma correction profile corresponding to the third color channel during a third timeslot.

10. The integrated circuit of claim 9, further comprising a fourth color channel, wherein a fourth set of switches defining a fourth set of gamma adjustment locations on the resistor string is selected based upon a fourth gamma correction profile corresponding to the fourth color channel during a fourth timeslot.

11. The integrated circuit of claim 8, comprising a timing generator block configured to supply timing signals to a gate driver integrated circuit configured to provide scanning signals to an addressed row of unit pixels of a display panel.

12. The integrated circuit of claim 11, comprising a frame buffer configured to receive the selected voltage level output from the gamma processing block and to provide the selected voltage level output to the display panel via a set of source lines.

13. A method for manufacturing a display device, comprising:

providing a display panel having a plurality of unit pixels arranged in columns and rows defined by source lines and gate lines, respectively, wherein each unit pixel is coupled to an intersection of a source line and a gate line, and wherein the display panel comprises a plurality of color channels;

coupling a source driver integrated circuit (IC) to the display panel, wherein the source driver IC is configured to receive image data corresponding to each of the plurality of color channels and to drive the display panel for displaying images, the source driver IC comprising:

gamma control logic configured to store a gamma correction profile for each of the plurality of color channels;

gamma adjustment circuitry configured to select for each color channel, a respective set of gamma adjustment points for providing a respective set of gamma adjustment voltages to a digital-to-analog converter configured to provide a plurality of output voltage levels, wherein the selection of the respective set of gamma adjustment points is based upon a respective gamma correction profile for a corresponding color channel; and a selection circuit configured to select one of the output voltage levels based upon a selection signal;

wherein each respective gamma correction profile defines a respective one of a set of gamma adjustment points determined based upon transmittance sensitivity characteristics associated with a transmittance versus voltage curve of a respective color channel, wherein the respective one of the set of gamma adjustment points is configured to substantially optimize a portion of respective one of the set of gamma adjustment points to concentrate in a voltage range that corresponds to an area comprising a maximum absolute value of the transmittance sensitivity characteristics of the respective color channel; and coupling a gate driver IC to the display panel, wherein the gate driver IC is configured to sequentially activate rows of unit pixels based upon timing signals provided by the source driver IC.

14. The method of claim 13, wherein the digital-to-analog converter comprises one or more resistor strings comprising a plurality of resistors.

15. The method of claim 14, wherein the one or more resistor strings comprises a single resistor string, and wherein the output voltage levels for each color channel are provided by the single resistor string using a time division multiplexing scheme.

16. The method of claim 13, wherein providing the display panel comprises providing one of a normally-black or a normally-white liquid crystal display (LCD).

17. A method, comprising:

providing a gamma correction profile for each of a plurality of color channels in a display device;

applying a respective gamma correction profile to a gamma adjustment circuit associated with each color channel, wherein the gamma correction profile for each color channel comprises data representative of locations of gamma adjustment points to be applied to a particular color channel to compensate for gamma inaccuracies of the display device, wherein the locations of the gamma adjustment points are determined by substantially optimizing a portion of the gamma adjustment points to concentrate in a voltage range that corresponds to the maximum transmittance sensitivity characteristics of the particular color channel;

applying for each gamma adjustment circuit a respective set of gamma adjustment voltages to respective gamma adjustment points corresponding to a respective applied gamma correction profile;

providing from each gamma adjustment circuit a plurality of adjusted voltage outputs, the voltage outputs having been adjusted based upon the respectively applied set of gamma adjustment voltages;

selecting one of the plurality of voltage outputs using a selection circuit; and outputting the selected voltage output to a display panel.

18. The method of claim 17, wherein each gamma adjustment circuit comprises a resistor string having a plurality of resistors, and wherein each of a respective set of gamma adjustment points corresponds to a respective location along the resistor string.

19. The method of claim 18, wherein each of a set of gamma adjustment voltages is supplied to a switching logic block coupled to a respective resistor string by way of a plurality of switches, wherein each of the plurality of switches is coupled to different voltage outputs on the respective resistor string, and wherein determining a respective set of gamma adjustment points based upon the respectively applied gamma correction profile comprises:

transmitting respective control signals from a control circuit to each of the switching logic blocks; and selecting a switch within each switching block based upon a respective control signal, wherein the selection of the switch couples the gamma adjustment voltage signal received by the switching block to a location on the respective resistor string that corresponds to the selected switch.

20. The method of claim 17, wherein digital level values of the image data are represented by N bits, and wherein a number of the voltage outputs for each gamma adjustment circuit comprises $2^N$ output voltages.

21. The method of claim 17, wherein a number of the gamma adjustment points for each color channel increases proportionately as the sensitivity transmittance of the color channel increases.

22. One or more non-transitory tangible computer-readable storage media comprising a computer program product, the computer program product comprising:

code to determine a maximum and minimum voltage value at which to apply gamma adjustment voltages for a color channel of a display device based at least partially upon a transmittance sensitivity curve for the color channel and a desired white balance and to select gamma adjustment points corresponding to each of the determined maximum and minimum voltage values, wherein the transmittance sensitivity curve is determined based at least in part on a transmittance versus voltage curve for the channel;

code to determine a first voltage range corresponding to a region over which the color channel exhibits a highest degree of sensitivity and to select one or more gamma adjustment points along a resistor string that corresponds to the color channel such that the resistor string outputs a plurality of voltages generally distributed within the first voltage range, wherein the code to select the one or more gamma adjustment points comprises substantially optimizing a portion of the one or more gamma adjustment points to concentrate in the first voltage range; and code to store the selected gamma adjustment points as a gamma correction profile.

23. The one or more non-transitory tangible, computer-readable storage media of claim 22, comprising:

code to determine a second voltage range corresponding to a region of the transmittance sensitivity curve between the region of the highest degree of sensitivity and one of the minimum or the maximum applied voltages; and code to select at least one gamma adjustment point within the second voltage range.

24. The one or more non-transitory tangible, computer-readable storage media of claim 22, wherein the gamma adjustment points are selected based at least partially upon empirical data.

25. The one or more non-transitory tangible, computer-readable storage media of claim 22, comprising code to determine, based upon the gamma correction profile, values corresponding to control signals to be transmitted to switching circuitry configured to select gamma adjustment points in a gamma adjustment circuit, such that the gamma adjustment points selected within the gamma adjustment circuit correspond to the gamma adjustment points defined in the stored the gamma correction profile.

* * * * *